US011828111B2

(12) United States Patent
Symonds et al.

(10) Patent No.: US 11,828,111 B2
(45) Date of Patent: Nov. 28, 2023

(54) APPARATUS AND METHOD RELATING TO MANAGED PRESSURE DRILLING

(71) Applicant: Oil States Industries (UK) Limited, Aberdeen (GB)

(72) Inventors: David Symonds, Lothian (GB); Richard Johnston, West Lothian (GB); Gordon Neil Wallace, North Lanarkshire (GB); Garry Stephen, Angus (GB)

(73) Assignee: Oil States Industries (UK) Limited, Aberdeen (GB)

( * ) Notice: Subject to any disclaimer, the term of this patent is extended or adjusted under 35 U.S.C. 154(b) by 393 days.

(21) Appl. No.: 17/277,628

(22) PCT Filed: Nov. 5, 2019

(86) PCT No.: PCT/GB2019/053134
§ 371 (c)(1),
(2) Date: Mar. 18, 2021

(87) PCT Pub. No.: WO2020/095040
PCT Pub. Date: May 14, 2020

(65) Prior Publication Data

US 2021/0348450 A1 Nov. 11, 2021

(30) Foreign Application Priority Data

Nov. 6, 2018 (GB) ..... 1818114

(51) Int. Cl.
*E21B 17/01* (2006.01)
*E21B 33/08* (2006.01)
(Continued)

(52) U.S. Cl.
CPC ..... *E21B 17/03* (2013.01); *E21B 17/01* (2013.01); *E21B 33/127* (2013.01)

(58) Field of Classification Search
CPC ..... E21B 33/085; E21B 33/08; E21B 33/126; E21B 33/127; E21B 17/01; E21B 23/01; E21B 23/06
See application file for complete search history.

(56) References Cited

U.S. PATENT DOCUMENTS 7,165,610 B2 * 1/2007 Hopper ..... E21B 33/085 166/84.1
8,100,189 B2 * 1/2012 Edvardson ..... E21B 33/08 166/387
(Continued)

FOREIGN PATENT DOCUMENTS

EP 0202726 5/1986
EP 2420647 2/2012
(Continued)

OTHER PUBLICATIONS

Patent Cooperation Treaty; PCT/GB2019/053134; International Search Report and Written Opinion; dated Feb. 5, 2020.
(Continued)

*Primary Examiner* — Kenneth L Thompson
(74) *Attorney, Agent, or Firm* — Morgan, Lewis & Bockius LLP

(57) ABSTRACT

The integration joint assembly includes an integration joint body (10) having a through bore (16), the body being for connection with a riser system. The integration joint assembly permits a tubular work string (50; 54) to pass there through such that there is an annulus created between the inner through bore (16) of the integration joint body (10) and the outer surface of the tubular work string (50; 54). The integration joint body (10) can also include at least two (300, 200) and more preferably three sealing devices (300, 200, 100) within its through bore (16). A method of drilling is also described as including the steps of installing an integration
(Continued)

joint assembly in a riser string and running a tubular work string (50; 54) through the through bore (16) thereof.

32 Claims, 15 Drawing Sheets

(51) Int. Cl.
*E21B 17/03* (2006.01)
*E21B 33/127* (2006.01)

(56) References Cited

U.S. PATENT DOCUMENTS

| | | | | |
|---|---|---|---|---|
| 8,347,983 | B2 * | 1/2013 | Hoyer | E21B 21/08 175/48 |
| 10,605,021 | B2 * | 3/2020 | Le | E21B 23/00 |
| 10,612,336 | B2 * | 4/2020 | Lewis | E21B 44/00 |
| 10,648,258 | B2 * | 5/2020 | Bakker | E21B 33/085 |
| 11,149,507 | B2 * | 10/2021 | Tran | E21B 33/085 |
| 2003/0213601 | A1 | 11/2003 | Schwendemann et al. | |
| 2008/0105434 | A1 | 5/2008 | Orbell et al. | |
| 2009/0071641 | A1 | 3/2009 | Gaudette et al. | |
| 2010/0148447 | A1 | 6/2010 | Halling | |
| 2010/0175882 | A1 | 7/2010 | Bailey et al. | |
| 2011/0024195 | A1 | 2/2011 | Hoyer et al. | |
| 2012/0043726 | A1 | 2/2012 | Zubia et al. | |
| 2015/0218903 | A1 | 8/2015 | Sellers et al. | |
| 2015/0376972 | A1 * | 12/2015 | Lock | E21B 33/085 166/381 |
| 2016/0334018 | A1 | 11/2016 | Travis et al. | |
| 2016/0369586 | A1 | 12/2016 | Morehead et al. | |

FOREIGN PATENT DOCUMENTS

| | | |
|---|---|---|
| GB | 2503981 | 1/2014 |
| GB | 2524404 | 9/2015 |
| GB | 2540963 | 2/2017 |
| WO | 2014038956 | 3/2014 |
| WO | 2015188269 | 12/2015 |
| WO | 2017039434 | 3/2017 |
| WO | 2018229457 | 12/2018 |
| WO | 2019098993 | 5/2019 |

OTHER PUBLICATIONS

Intellectual Property Office; GB1916078.7, Apr. 30, 2020, Search Report under Section 17.
Patent Cooperation Treaty; PCT/GB2019/053134; May 11, 2021; International Preliminary Report on Patentability.
Intellectual Property Office, GB; GB2006478.8; Combined Search and Examination Report under Sections 17 & 18(3); dated May 4, 2021.
Intellectual Property Office, GB; GB2006478.8; Search Report under Section 17; dated Oct. 26, 2020.
Intellectual Property Office, GB; GB1906260.3; Aug. 3, 2019.

* cited by examiner

APPARATUS AND METHOD RELATING TO MANAGED PRESSURE DRILLING

BACKGROUND OF THE INVENTION

The present invention relates to an apparatus and method relating to managed pressure drilling and in particular relates to a managed pressure drilling (MPD) integration joint comprising a rotating control device (RCD) and/or an annular seal.

When drilling for offshore hydrocarbons, some target reservoirs are located in difficult formations such as clastic, carbonate or pre-salt formations. Such formations require managed pressure drilling (MPD) in which the drill string is run through a riser and the pressure of the returning drilling fluid is controlled within the annulus between the outside of the drill string and the inner through bore of the riser.

The drilling fluid is typically pumped down the drill string and exists the bottom of the drill string through the BHA and the drill bit and returns up the annulus between the outside of the drill string and the inside of the riser. Deep water MPD systems typically include an integration joint which typically consists of three or more components all connected in line in the riser system. These three components typically comprise an annular seal within a separate tubular and an RCD located above the annular seal within its own separate tubular, where the integration joint is located in line/in series within the riser string above an MPD flow spool and below a telescopic joint. The RCD, the annular seal and the MPD flow spool along with the other components in the riser system all act together to enable closed loop drilling in deep water environments.

The RCD permits passage of the drill string through the riser but also seals around the drill string whilst permitting rotation of it thereby preventing pressurised drilling fluid from passing further up the annulus in the riser string. Accordingly, the RCD forces the returning drilling fluid to flow out of the annulus in the riser string and through goose necks provided at each side of the MPD flow spool where the goose necks are attached to drilling fluid return hoses.

Additional information and drawings regarding conventional integrated MPD systems can be read in Volume 76, Issue 10 of Offshore magazine and at the time of writing an online version is available at:— https://www.offshore-mag.com/articles/print/volume-76/issue-10/drilling-and-completion/integrated-mpd-system-aids-drilling-operation-offshore-brazil.html The skilled person will understand that because the different components that make up the integration joint (i.e. the RCD and the annular seal) are all located in line/series in separate tubular joints (each being around 20 feet in length) within the riser system, conventional MPD systems are relatively long/high in length and this carries the disadvantage that the MPD flow spool is relatively low compared to the moon pool of the drilling vessel in question and therefore it can be difficult for the operator to connect the drilling return fluid hoses to the goose neck outlet ports.

Moreover, because the different components that make up the integration joint (i.e. the RCD and annular seal) are all located in line/series in separate joints within the riser system and each tubular joint is connected to the next by a flange and bolting arrangement, it can be very difficult and very time consuming for an operator to change out for example one of the annular seals (e.g. if it is worn) for a new annular seal. Moreover, because the riser string needs to be broken out to enable that tubular annular seal to be removed from the string to allow for the new annulus seal to be included in the string, the operator loses the ability to control the pressure within the riser system and indeed the whole drill string must first be removed from the riser string.

US Patent Publication No. US2012/0085545 to Tarique et al discloses a bearing assembly 37 which comprises an upper stripper element 54 and a lower stripper element 52 both being provided within and run into or pulled from a rotating flow head housing 30 within a bearing assembly housing 40. Accordingly, in order to replace one of the stripper elements 54, 52, both of them within the bearing assembly housing 40 must be pulled from the RFH housing 30 and hence the riser must be taken out of active (pressurised) use whilst that occurs.

It is an object of the present invention to eliminate or ameliorate some or all of the above-noted disadvantages.

SUMMARY OF THE INVENTION

According to a first aspect of the present invention there is provided an integration joint assembly for use in drilling operations, the integration joint assembly comprising:— an integration joint body comprising:— a through bore;

an upper end adapted for connection with an upper portion of a riser system; and a lower end adapted for connection with a lower portion of a riser system;

the integration joint assembly being adapted to permit a tubular work string to pass there through such that there is an annulus created between the inner through bore of the integration joint body and the outer surface of the tubular work string;

wherein the integration joint assembly further comprises at least two sealing devices adapted in use to provide a seal within the said annulus;

wherein the said at least two sealing devices and the integration joint body are adapted such that the said at least two sealing devices are capable of being located within the through bore of the integration joint body;

wherein, each of the said at least two sealing devices are capable of being locked within the through bore by at least two locking devices and wherein each of the at least two sealing devices comprise their own respective locking device; and wherein each of the said at least two sealing devices can be separately locked and unlocked as required by actuation of their own respective locking device in such a manner to permit one of the sealing devices to be locked within the through bore and at least one of the at least two sealing devices to be run into and/or retrieved from the through bore of the integration joint body.

According to a second aspect of the present invention there is provided a method of drilling comprising the step of:— installing an integration joint body according to the first aspect of the present invention in a riser string and running a tubular work string through the through bore thereof.

Preferably the integration joint assembly is for use in managed pressure drilling operations and typically the tubular work string is a drill string.

Preferably, each of the said at least two sealing devices comprises a housing and a seal mounted within said housing, and more preferably, each of the said at least two sealing devices comprises its own respective housing.

Typically, each of said at least two sealing devices comprises a housing and at least one seal mounted within said housing.

Preferably, at least one of said at least two sealing devices comprises a housing and two seals rotatably mounted within said housing by a respective bearing mechanism.

Typically, each of the said at least two sealing devices is in the form of a cartridge assembly and preferably, each of the said at least two sealing devices comprises a retrieval means to permit running in and/or retrieval of the respective each of the said at least two sealing devices.

Preferably, each housing comprises a locking means into which a respective locking device can engage in order to lock said housing of said respective sealing device within the through bore of the integration joint body. Said locking means may comprise a slot, groove or recess into which a locking device such as a locking dog may be inserted.

Preferably, each said locking device is mounted on the integration joint. Preferably, each said locking device comprises one or more radially moveable dog members which can be moved radially inwardly to projecting inwardly from the inner diameter of the integration joint body and more preferably can be moved radially inwardly to projecting inwardly from the inner diameter of the integration joint body into the said locking means of the respective sealing device. Typically, each said locking device can be actuated between a radially inwardly projecting configuration and a retracted configuration such that they do not project into said locking means of the respective sealing device. Preferably, each said locking device is remotely actuatable (such as from the surface by an operator) between the radially inwardly projecting or locked configuration and the retracted or unlocked configuration, allowing for remote activation of each of the locking devices by the operator.

Preferably the said at least two sealing devices are adapted to be located co-axially within the through bore of the integration joint body and more preferably the longitudinal length of the integration joint body is longer than the combined longitudinal length of the said at least two sealing devices and more preferably the inner diameter of the integration joint body is greater than the outer diameter of each of the said at least two sealing devices such that the said at least two sealing devices are adapted to be wholly located co-axially within the integration joint body and most preferably the said at least two sealing devices are adapted to be wholly located co-axially within the through bore of the integration joint body.

Preferably, the said at least two sealing devices comprise:— a rotation control device (RCD); and at least one annular seal device;

wherein said at least two sealing devices are adapted to be located within the through bore of the integration joint body. Preferably, the integration joint body is adapted to be able to house both of a rotation control device (RCD) and two said annular seal devices within its through bore, preferably in series/in line along its longitudinal length.

Preferably, at least one of the rotation control device and the annular seal device can be:— i) run into the through bore of the integration body, typically through an upper portion of the riser string which typically includes a telescopic joint; and ii) locked to the integration joint body within the through bore of the integration joint body.

Preferably at least one of the rotation control device and the annular seal device are capable of being unlocked from and more preferably retrieved from the through bore of the integration joint body, typically by pulling it upwards through the through bore of the integration joint body and further pulling it upwards through the through bore of the upper portion of the riser system (which may include the telescopic joint).

Preferably the rotation control device is arranged to be located above the annular seal device within the through bore of the integration joint body.

Preferably there are two annular seal devices and more preferably there is an upper annular seal device and a lower annular seal device.

The rotation control device may be retrieved and run into the through bore on its own by a running/retrieval tool or alternatively, may be retrieved and run into the through bore with at least one of the annular sealing devices.

One or both of the rotation control device and the at least one annular seal device may be located within the through bore of and locked to the integration joint body when the integration joint body is installed within the riser string; or one or both of the rotation control device and the at least one annular seal device may be run into the through bore of the integration body through the through bore of an upper portion of the riser string (which could include the telescopic joint) and be locked to the integration joint body within the through bore of the integration joint body after the integration joint body has been installed within riser string.

Typically, suitable seals such as (but not limited to) O-ring seals, pressure activated seals or mechanically activated seals are provided to act between the outer surface of the RCD and the inner through bore of the integration joint body. Preferably said seals are provided on and/or around the outer circumferential surface of the RCD such that they act to seal the gap between the outer surface of the RCD and the inner through bore of the integration joint body.

Additionally, further suitable seals such as (but not limited to) O-ring, pressure activated seals or mechanically activated seals are typically provided to act between the outer surface of the said at least one annular seal and the inner through bore of the integration joint body. Preferably said seals are provided on and/or around the outer circumferential surface of the said at least one annular seal such that they act to seal the gap between the outer surface of the said at least one annular seal and the inner through bore of the integration joint body.

Typically, suitable seals such as (but not limited to) O-ring, pressure activated seals or mechanically activated seals are provided to act between the adjoining ends of the RCD and the said at least one annular seal.

Preferably the integration joint body comprises a seat or other formation formed on its inner through bore preferably at a location on its inner diameter and which prevents the rotation control device and the one or more annular seal devices from moving any lower through the integration joint body than said seat. Typically, the said seat is a formation formed on the inner diameter of the integration joint body and more preferably said formation comprises a narrower inner diameter load bearing shoulder than the outer diameter of at least a portion of the rotation control device and the one or more annular seal devices such that the said portion seats upon said shoulder and thus any further downward movement of the rotation control device and the one or more annular seal devices is arrested. Typically, the said formation comprises a narrower inner diameter load bearing shoulder than the outer diameter of at least a portion of a lowermost annular seal device. Alternatively, said seat or other formation comprises one or more radially moveable dog members which can be moved radially inwardly to provide a shoulder projecting inwardly from the inner diameter of the integration joint body for the said annular devices to seat upon in order to prevent the rotation control device and the one or more annular seal devices from moving any lower through the integration joint body than said shoulder or seat.

Typically, the RCD comprises an RCD body member and at least one and preferably two seals which more preferably are rotatable with respect to the RCD body member. Typically, the RCD further comprises a bearing to couple each respective seal to the RCD body member such that the said each respective seal is rotatable on the bearing with respect to the stationary RCD body member such that the said each respective seal seals against and is rotatable with the drill string which passes through the through bore of the integration joint body. Preferably the RCD comprises a pair of longitudinally spaced apart rotatable seals such that the RCD comprises an in use upper most rotatable seal and a lowermost rotatable seal. Preferably each of the upper and lower rotatable seals is formed from a resilient material such as rubber or polyurethane and has an inner diameter which is a friction fit or comprises a smaller inner diameter that the outer diameter of the drill string such that each of the upper and lower rotatable seals elastically stretches to accommodate the drill string and seals against the outer surface of the drill string such that it does not permit drilling fluid located in the annulus to pass through the through bore of the RCD in the upwards direction from downhole to up-hole.

Typically, each of the said annular seals comprises an in use de-energised or deflated inner diameter which is greater than the outer diameter of the drill string which passes there through such that when each of the said annular seals in use is de-energised it allows the free movement of the drill string there through and therefore does not impede the movement there through and therefore does not seal against the outer diameter of the drill string.

In addition, each of the said annular seals typically comprises an in use energised or inflated inner diameter which is smaller than the outer diameter of the drill string which passes there through such that when each of the said annular seals in use is energised it seals against the outer diameter of the drill string and therefore does not permit drilling fluid located in the annulus to pass through the through bore of the annular seal in the upwards direction from downhole to up-hole. Preferably each annular seal can be selectively energised or de-energised by the respective introduction or removal of fluid from a cavity in fluid communication with a surface of the said annular seal and more preferably said cavity is in fluid communication with an outer surface of the said annular seal such that when fluid is pumped into said cavity, the said annular seal is forced inwards into contact with tubular work string passing through the integration joint body to thereby form a seal in the annulus between the outer surface of the tubular work string and the inner through bore of the integration joint body.

Preferably, the locking devices are configured such that in use, in the locked configuration, the respective sealing device cannot move relative to the integration joint body and in the unlocked configuration the respective sealing device can move relative to the integration joint body. This provides for a locking system wherein when the respective locking device is moved from the unlocked configuration to the locked configuration the respective sealing device can move relative to the integration joint body.

The embodiments of the present invention have many advantages including great flexibility due to the modular nature of the sealing devices and the skilled person will understand that the RCD may be omitted if the riser system in question requires to be run in a conventional mode (not managed pressure drilling) but be able to maintain the ability to operate as a gas handling joint.

Embodiments of the present invention have the great advantage that the riser string does not need to be pulled up and taken apart in order to replace any one or more than one of the rotation control device and the at least one annular seal device because they can be run into and retrieved from the through bore of the integration joint body.

The accompanying drawings illustrate presently exemplary embodiments of the disclosure and together with the general description given above and the detailed description of the embodiments given below, serve to explain, by way of example, the principles of the disclosure.

In the description that follows, like parts are marked throughout the specification and drawings with the same reference numerals, respectively. The drawings are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments of the present invention are shown in the drawings and herein will be described in detail, with the understanding that the present disclosure is to be considered an exemplification of the principles of the invention and is not intended to limit the invention to that illustrated and described herein. It is to be fully recognized that the different teachings of the embodiments discussed below may be employed separately or in any suitable combination to produce the desired results.

The following definitions will be followed in the specification. As used herein, the term "wellbore" refers to a wellbore or borehole being provided or drilled in a manner known to those skilled in the art. The wellbore may be 'open hole' or 'cased', being lined with a tubular string. Reference to up or down will be made for purposes of description with the terms "above", "up", "upward", "upper" or "upstream" meaning away from the bottom of the wellbore along the longitudinal axis of a work string toward the surface and "below", "down", "downward", "lower" or "downstream" meaning toward the bottom of the wellbore along the longitudinal axis of the work string and away from the surface and deeper into the well, whether the well being referred to is a conventional vertical well or a deviated well and therefore includes the typical situation where a rig is above a wellhead and the well extends down from the wellhead into the formation, but also horizontal wells where the formation may not necessarily be below the wellhead. Similarly, 'work string' refers to any tubular arrangement for conveying fluids and/or tools from a surface into a wellbore. In the present invention, drill string is the preferred work string.

The various aspects of the present invention can be practiced alone or in combination with one or more of the other aspects, as will be appreciated by those skilled in the relevant arts. The various aspects of the invention can optionally be provided in combination with one or more of the optional features of the other aspects of the invention. Also, optional features described in relation to one embodiment can typically be combined alone or together with other features in different embodiments of the invention. Additionally, any feature disclosed in the specification can be combined alone or collectively with other features in the specification to form an invention.

Various embodiments and aspects of the invention will now be described in detail with reference to the accompanying figures. Still other aspects, features and advantages of the present invention are readily apparent from the entire description thereof, including the figures, which illustrates a number of exemplary embodiments and aspects and implementations. The invention is also capable of other and different embodiments and aspects and its several details can be modified in various respects, all without departing from the spirit and scope of the present invention.

Any discussion of documents, acts, materials, devices, articles and the like is included in the specification solely for the purpose of providing a context for the present invention. It is not suggested or represented that any or all of these matters formed part of the prior art base or were common general knowledge in the field relevant to the present invention.

Accordingly, the drawings and descriptions are to be regarded as illustrative in nature and not as restrictive. Furthermore, the terminology and phraseology used herein is solely used for descriptive purposes and should not be construed as limiting in scope. Language such as "including", "comprising", "having", "containing" or "involving" and variations thereof, is intended to be broad and encompass the subject matter listed thereafter, equivalents and additional subject matter not recited and is not intended to exclude other additives, components, integers or steps. In this disclosure, whenever a composition, an element or a group of elements is preceded with the transitional phrase "comprising", it is understood that we also contemplate the same composition, element or group of elements with transitional phrases "consisting essentially of", "consisting", "selected from the group of consisting of", "including" or "is" preceding the recitation of the composition, element or group of elements and vice versa. In this disclosure, the words "typically" or "optionally" are to be understood as being intended to indicate optional or non-essential features of the invention which are present in certain examples but which can be omitted in others without departing from the scope of the invention.

All numerical values in this disclosure are understood as being modified by "about". All singular forms of elements, or any other components described herein including (without limitations) components of the assembly are understood to include plural forms thereof and vice.

BRIEF DESCRIPTION OF AND INTRODUCTION TO THE DRAWINGS

Embodiments of the present invention will now be described, by way of example only and with reference to the accompanying drawings, in which:—

FIG. 1 is a cross-sectional view of an integration joint tubular body in accordance with the present invention which would be located in line in a riser string below a suitable telescopic joint and above a suitable MPD flow spool (both of which are not shown in FIG. 1) and prior to installation therein of a pair of annular packer seals and a rotating control device (RCD) bearing assembly which are also in accordance with the present invention;

FIG. 2 is a cross-sectional view of the integration joint tubular body of FIG. 1 but where a drill pipe string has been run through the through bore of the integration joint body and into the lower portion of the riser string and conventional (i.e. non-MPD) drilling can be conducted;

FIG. 3 shows a cross-sectional view of the integration joint body of FIG. 2 but shows the next stage of operation of the integration joint body following on from that of FIG. 2, where a running tool has been included in the drill pipe string and a lower packer annular seal, upper annular packer seal and RCD bearing assembly are run into the inner through bore of the integration joint body and thus the through bore of the riser string in order to form the integration joint assembly;

FIG. 4 shows the next stage of operation of the integration joint body following on from the previous stage of FIG. 3, where FIG. 4 shows the running tool having fully run in the lower annular packer seal, upper annular packer seal and RCD bearing assembly into the through bore of the integration joint body until the lower end of the lower annular packer seal has landed on a load shoulder of the integration joint body such that the lower annular packer seal, upper annular packer seal and RCD bearing assembly are now located in their in-use position but prior to locking into that in-use position;

FIG. 5 shows the next stage of operation of the integration joint body following on from that shown in FIG. 4, where FIG. 5 shows all locking dogs of the integration joint body have been extended into the through bore of the integration joint body such that they lock the lower annular packer seal, upper annular packer seal and RCD bearing assembly in their locked in-use position and FIG. 5 also shows that the running in tool has been pulled up out of the through bore of the integration joint body to leave the rest of the drill string located therein, such that managed pressure drilling operations can now be conducted;

FIG. 6 follows on from the stage of operation of FIG. 5 if the operator needs to replace one, more than one or all of the RCD bearing assembly, upper and lower annular packer seal cartridges, where the locking dogs of the integration joint body for the RCD bearing assembly have been retracted and a RCD retrieval tool has been included at the upper end of the drill string and has been run in through the RCD bearing assembly and is ready to retrieve the RCD bearing assembly (the retrieval thereof being shown in FIGS. 7 and 8);

FIG. 7 follows on from the stage of operation of FIG. 6 and shows the drill string and the retrieval tool have been raised such that the retrieval tool has picked up and lifted the RCD bearing assembly from its in-use position within the integration joint body;

FIG. 8 shows the next stage on from FIG. 7 where the RCD bearing assembly has been retrieved from and pulled out of the through bore of the integration joint body;

FIG. 9 shows the stage on from FIG. 8 with the RCD bearing assembly having been pulled out of the riser and further shows an upper annular packer seal retrieval tool having been included in the drill string at the upper end thereof and having been lowered into the through bore of the integration joint body and having been locked in to the retrieval profile of the upper annular packer seal, and this stage of operation is utilised if the upper annular packer seal needs to be retrieved and replaced;

Figure 3:
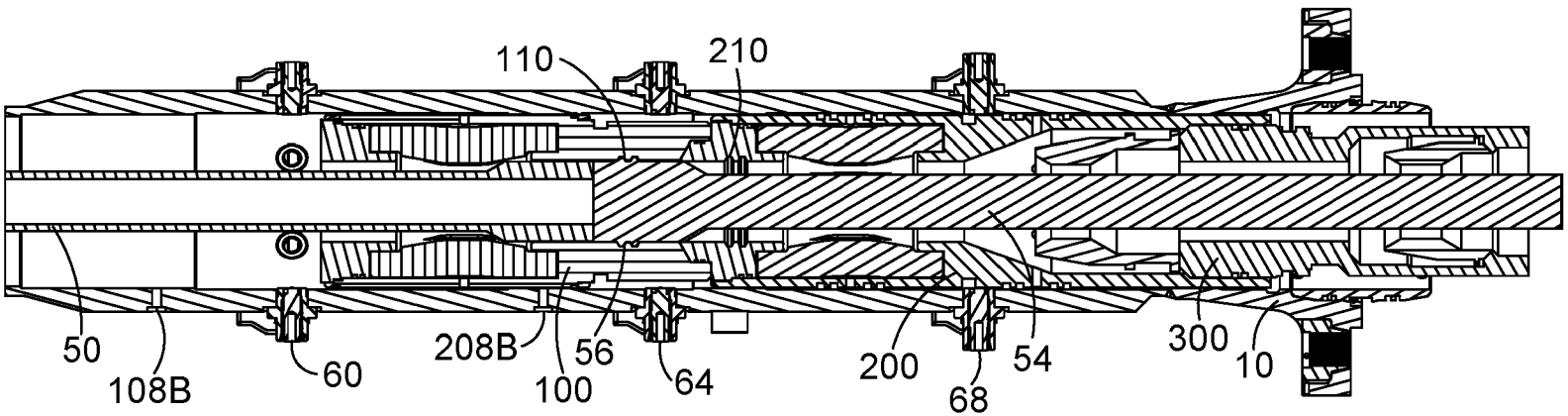
Figure 18:
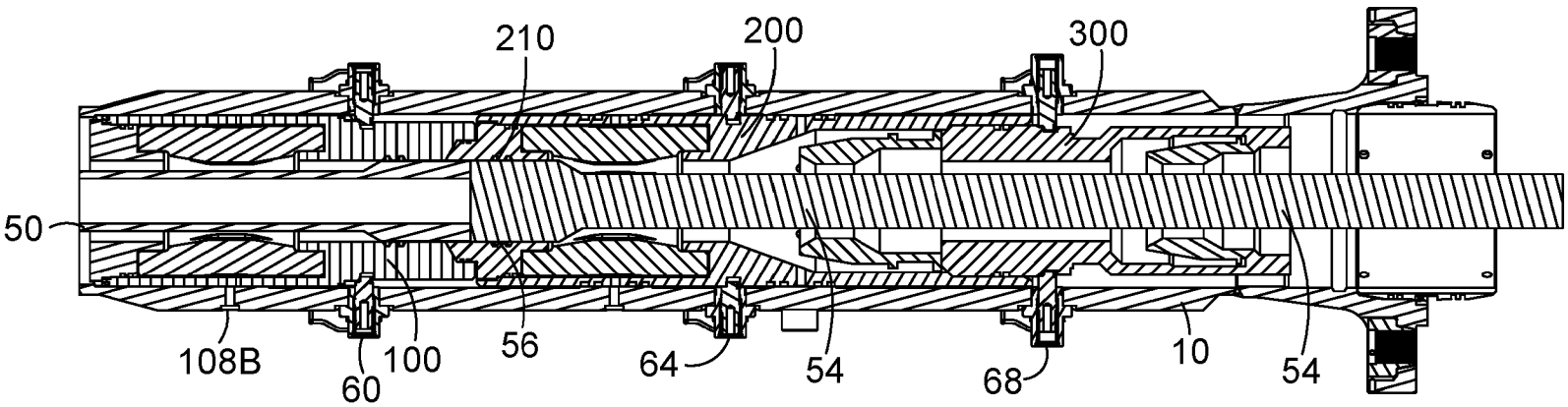
Figure 19:
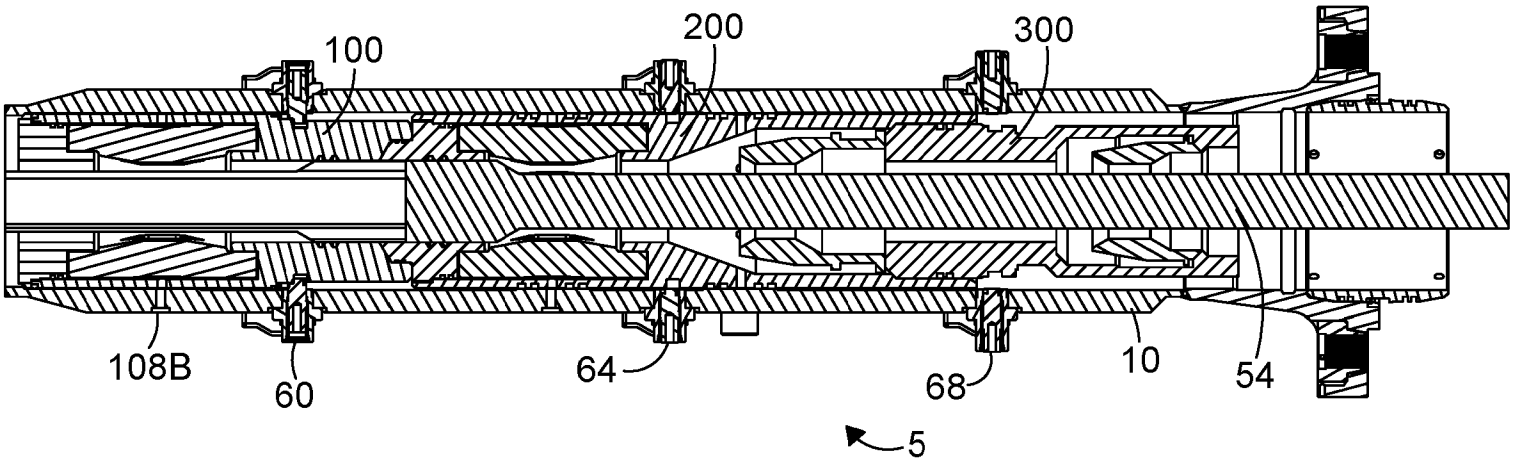
Figure 20:
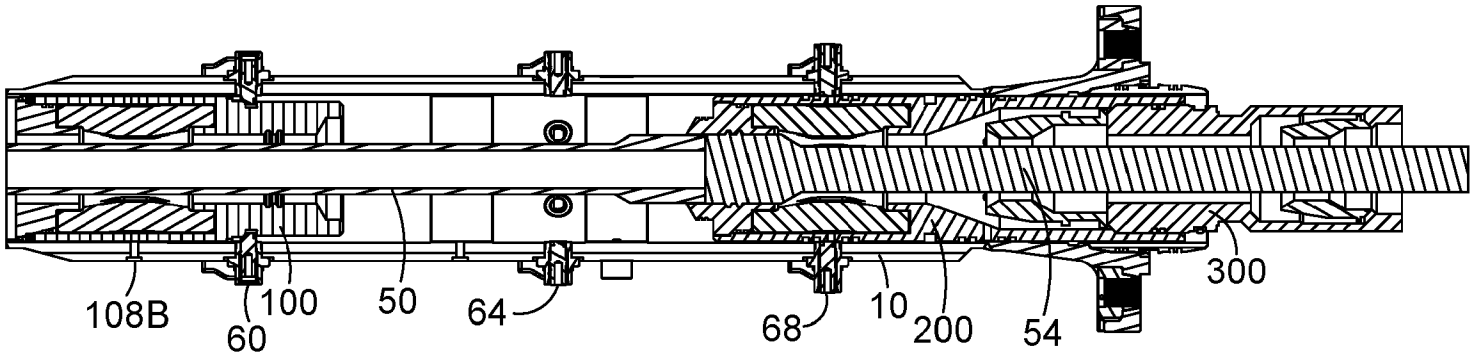
Figure 21:
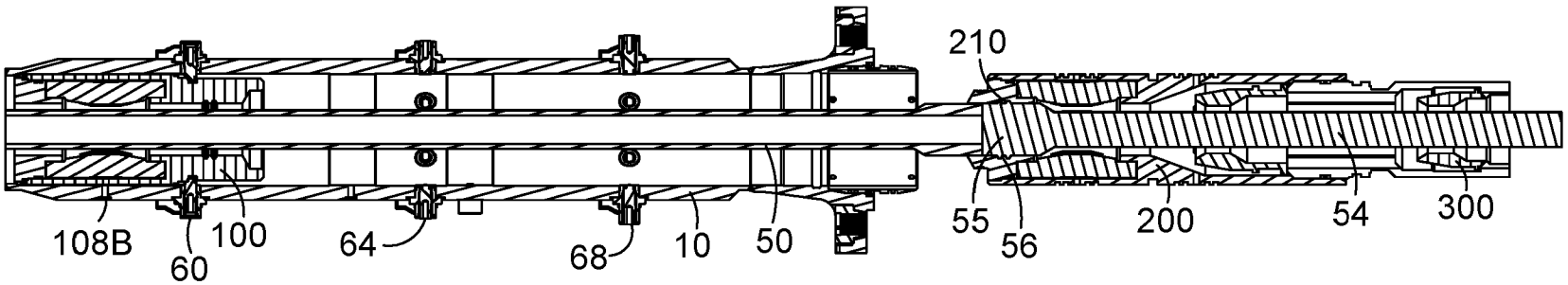
Figure 22:
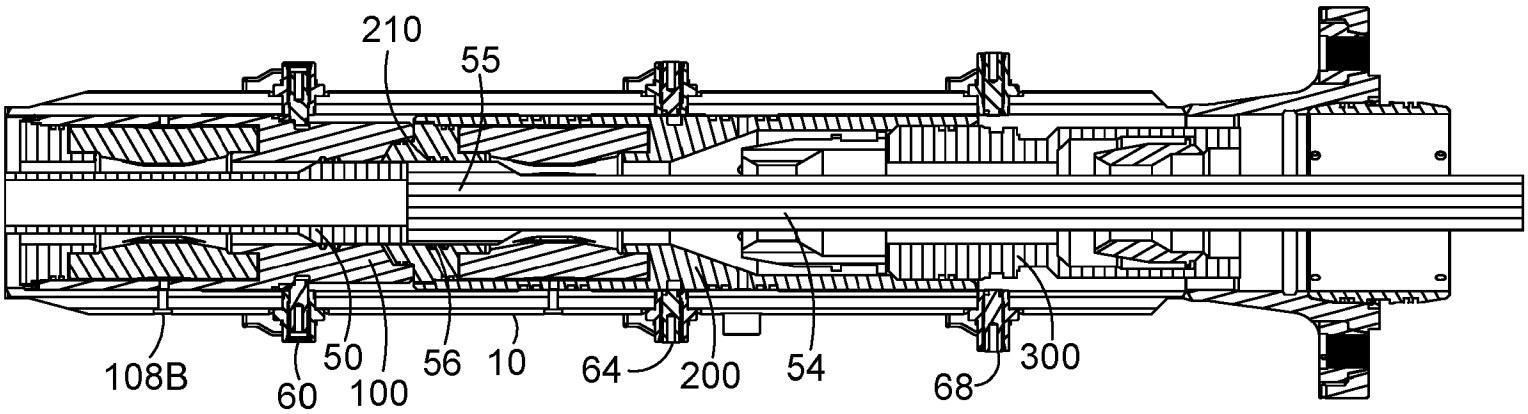
Figure 23:
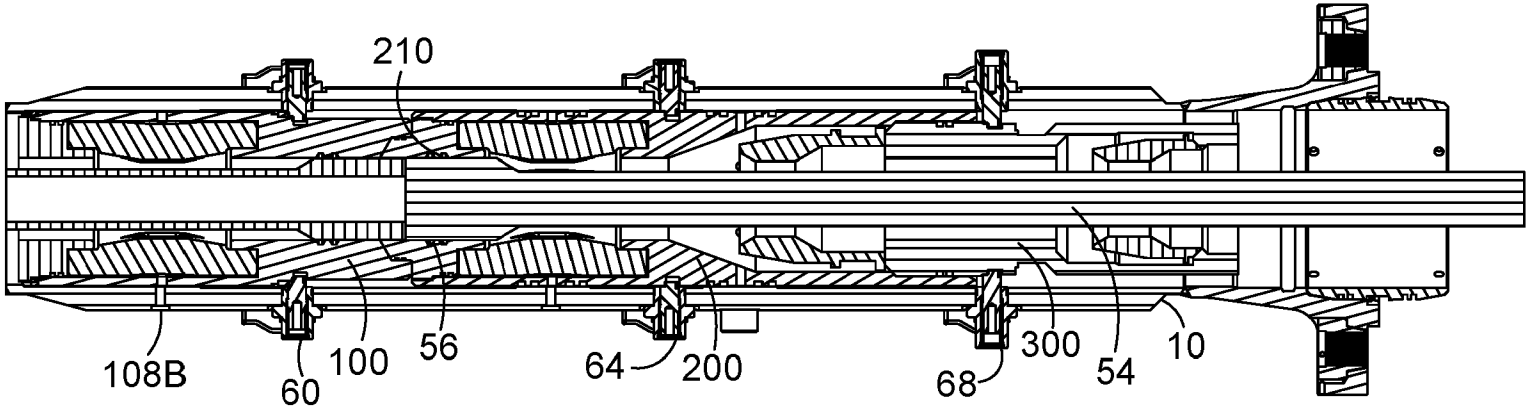
Figure 24:
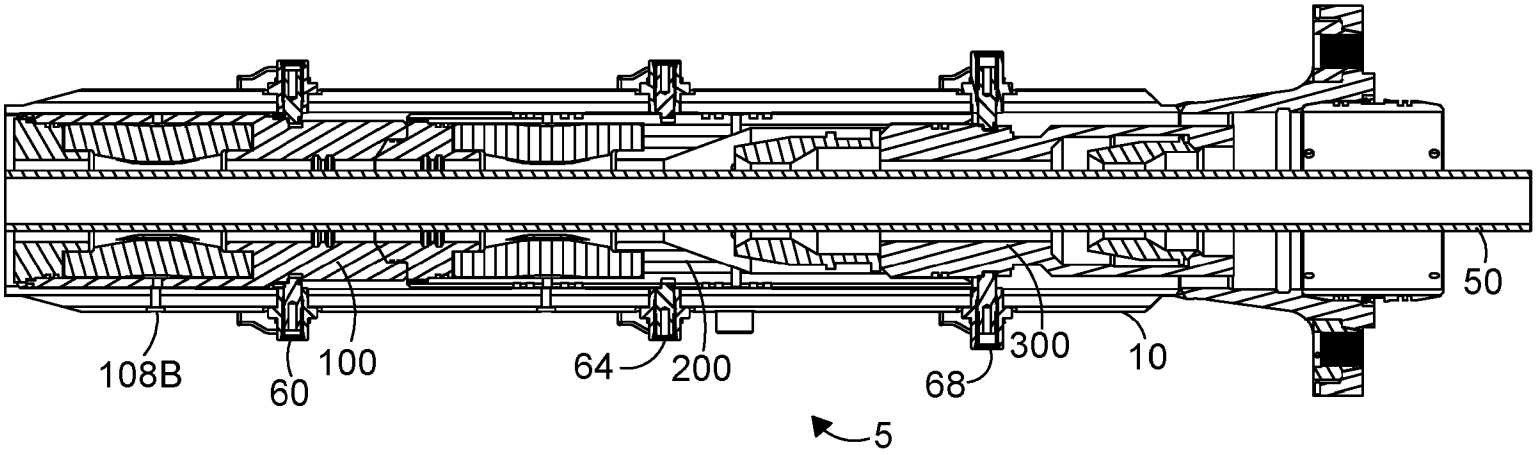
Figure 25A:
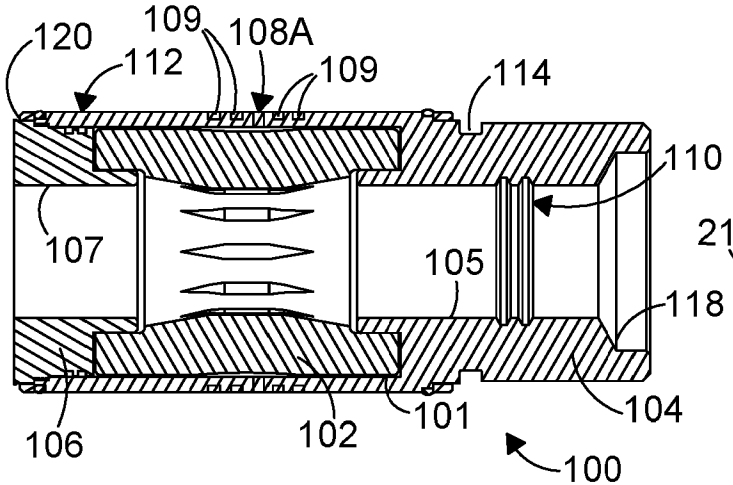
Figure 25B:
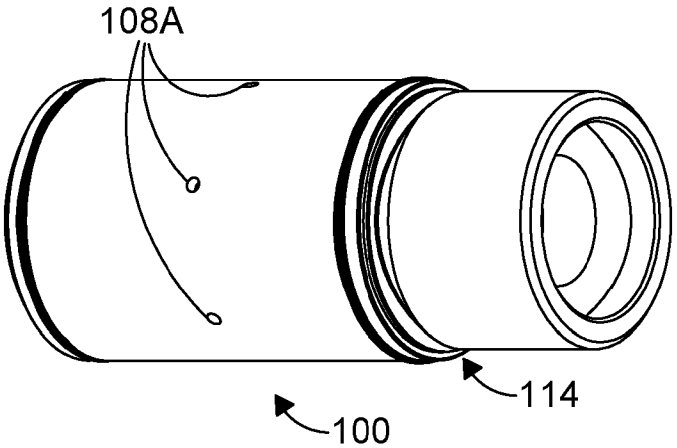

FIG. 18 shows an optional stage that can be commenced if an operator wishes to retrieve the RCD bearing assembly and the upper annular packer seal at the same time but also wishes to leave the lower annular packer seal locked in place within the integration joint body through bore and therefore shows a retrieval tool having been run on the top of the drill string into the through bore of the integration joint body and having been locked into a retrieval profile of the upper annular packer seal;

FIG. 19 shows the next stage on from that of FIG. 18 of the retrieval of the RCD bearing assembly and upper annular packer seal, where the RCD bearing assembly locking dogs and the upper annular packer seal cartridge locking dogs have both been retracted;

FIG. 20 shows the next stage on from that of FIG. 19 of the retrieval of the RCD bearing assembly and upper annular packer seal where the RCD bearing assembly and the upper annular packer seal cartridge are unseated from the lower annular packer seal cartridge and have been lifted by the retrieval tool from the through bore of the integration joint body;

FIG. 21 shows the next stage on from that of FIG. 20 where the RCD bearing assembly and upper annular packer seal cartridge have been completely pulled out of the through bore of the integration joint body;

FIG. 22 shows the next stage on from that of FIG. 21 where a new RCD bearing assembly and new upper annular packer seal cartridge have been run-in on a running tool into the through bore of the integration joint body and have been landed on top of the lower annular packer sealed cartridge;

FIG. 23 shows the next stage on from that of FIG. 22 where the locking dogs for both of the RCD bearing assembly and the upper annular packer seal cartridge have been extended in order to lock the RCD bearing assembly and the upper annular packer seal cartridge in place within the through bore of the integration joint body but the running in tool is still located within the through bore of the integration joint body;

FIG. 24 shows the next stage on from that of FIG. 23 where the running in tool has been pulled from the through bore of the integration joint body to leave the rest of the drill string located therein and thus the integration joint body and the RCD bearing assembly are operating in normal conditions where the RCD bearing assembly is sealing the annulus of the integration joint body;

FIG. 25*a* shows a cross-sectional view of the lower annular packer seal cartridge as used in the integration joint assembly of FIG. 3;

FIG. 25*b* shows a side view of the lower annular packer seal cartridge of FIG. 25*a;*

Figure 26A:
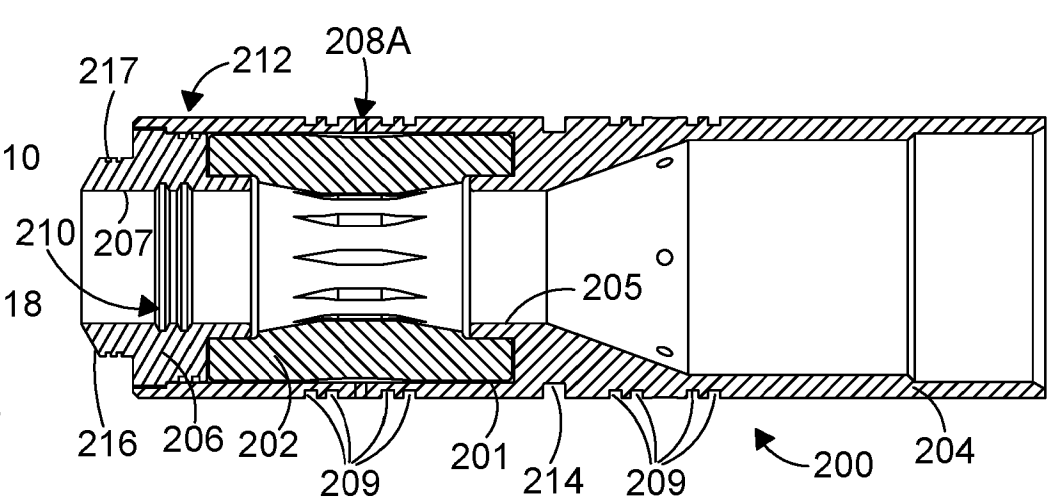
Figure 26B:
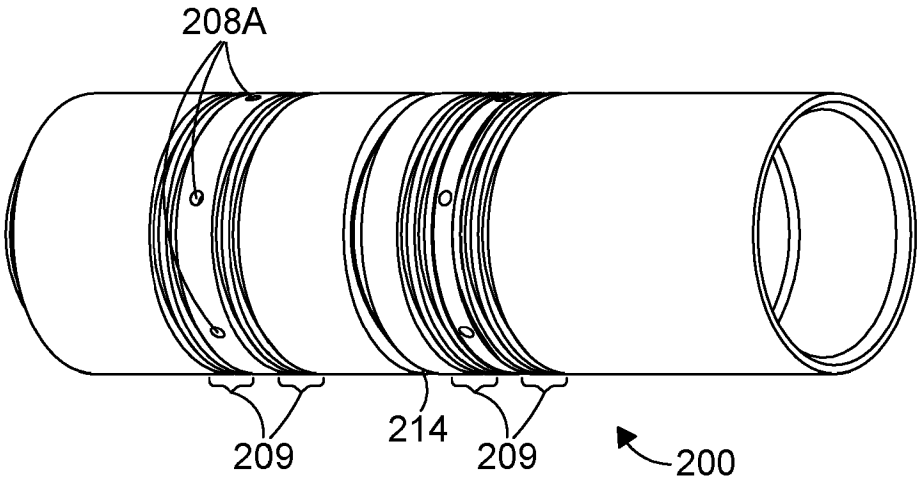

FIG. 26*a* shows a cross-sectional view of the upper annular packer seal cartridge as used in the integration joint assembly of FIG. 3;

FIG. 26*b* shows a side view of the upper annular packer seal cartridge of FIG. 26*a;*

Figure 27A:
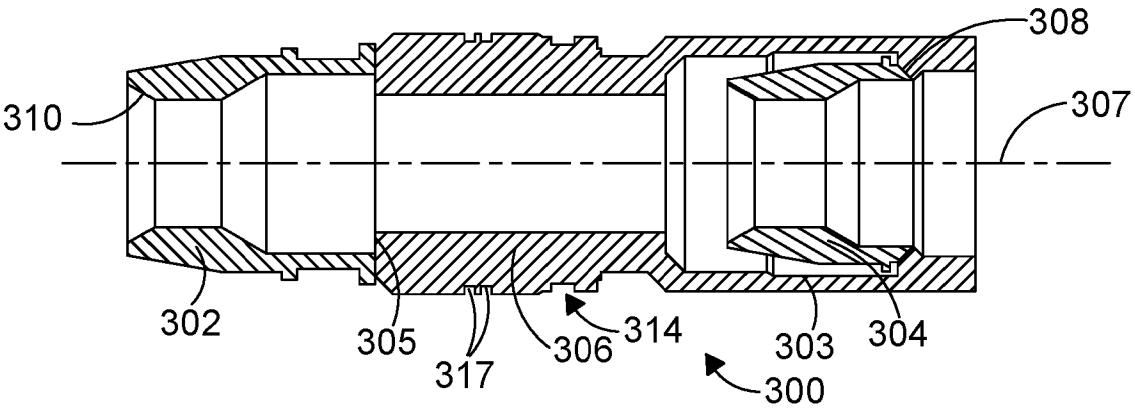
Figure 27B:
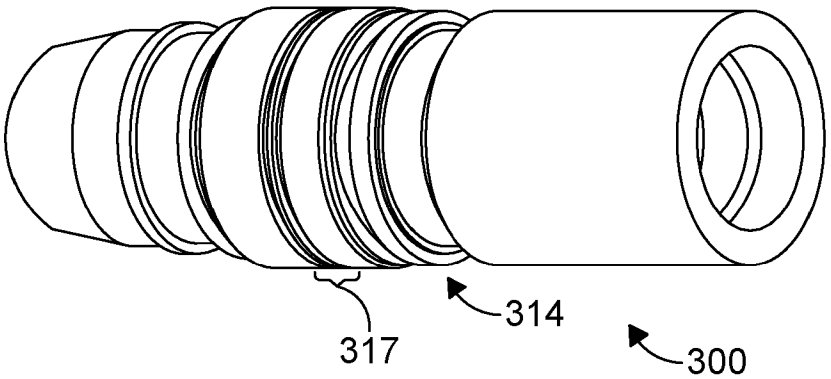

FIG. 27*a* shows a cross-sectional view of the RCD bearing assembly as used in the integration joint assembly of FIG. 3;

FIG. 27*b* shows a side view of the RCD bearing assembly of FIG. 27*a;*

Figure 4:
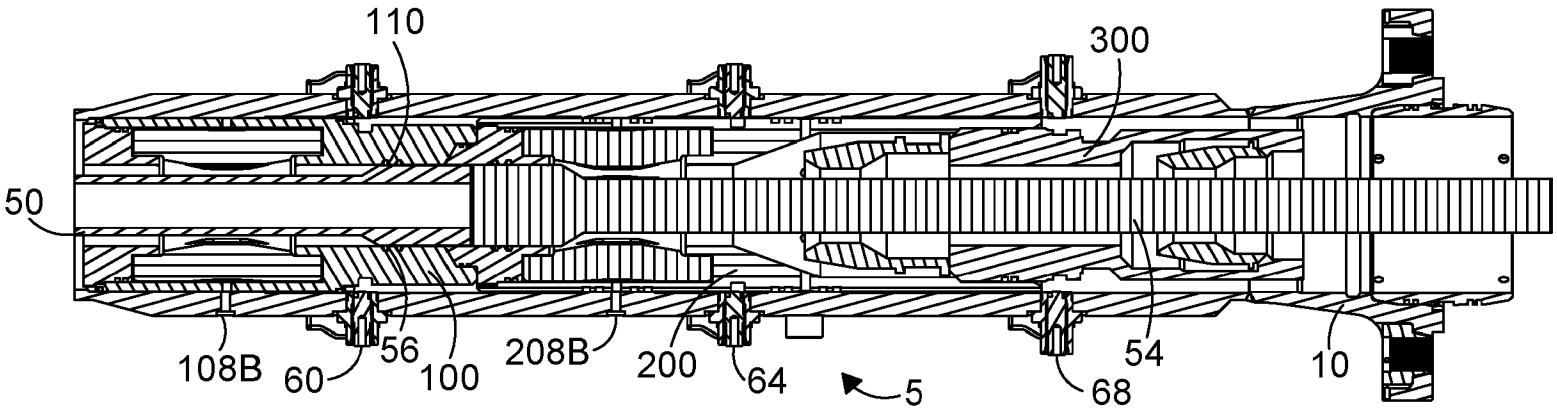
Figure 28:
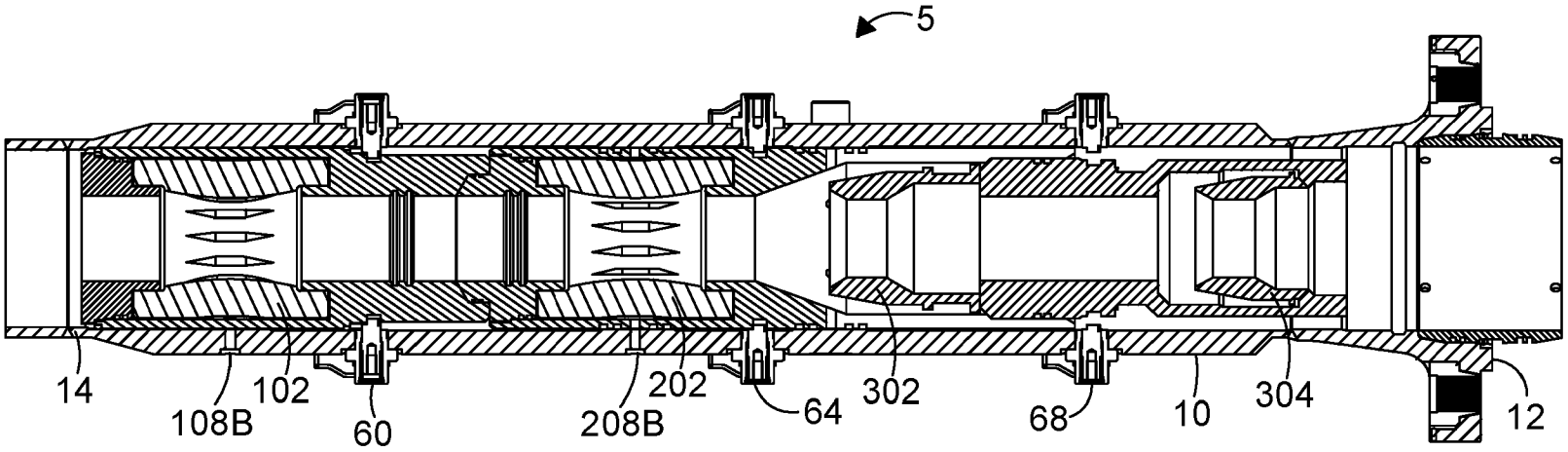
Figure 29:
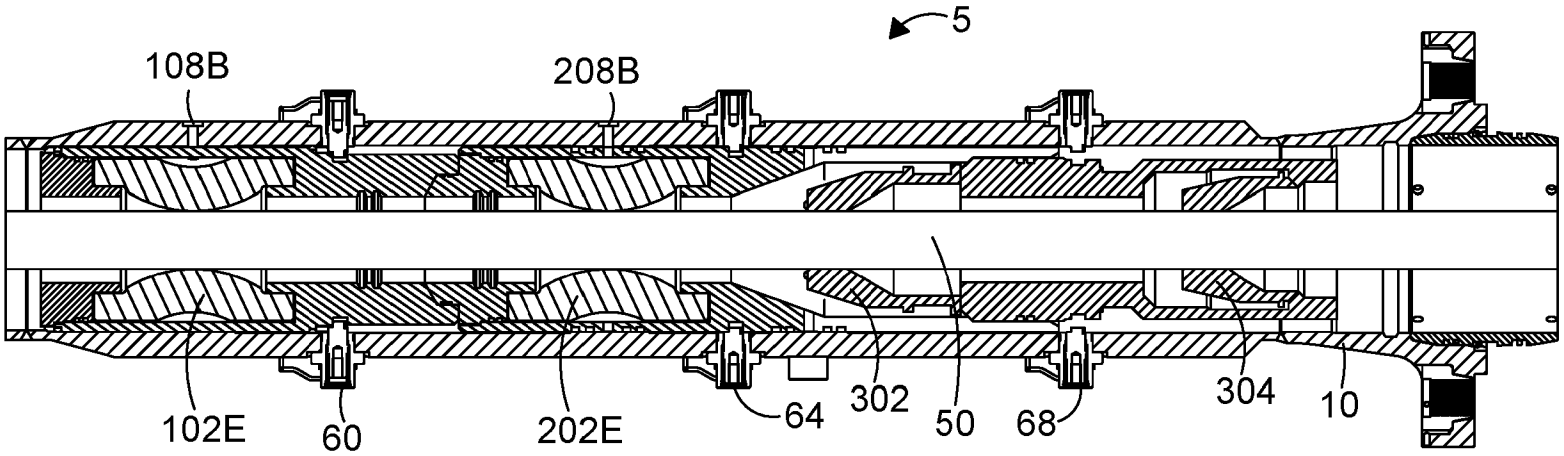

FIG. 28 shows a cross-sectional view of the integration joint assembly of FIG. 4 but without the running in tool nor the drill string being present and where the locking dogs of the RCD bearing assembly are retracted and where the upper and lower annular packer seals are de-energised; and FIG. 29 shows the integration joint assembly of FIG. 28 but where the drill string is present and the upper and lower annular packer seals have been energised around the outer surface of the drill string in order to further seal the annulus of the integration joint assembly.

DETAILED DESCRIPTION OF THE EMBODIMENTS OF PRESENT INVENTION

Figure 1:
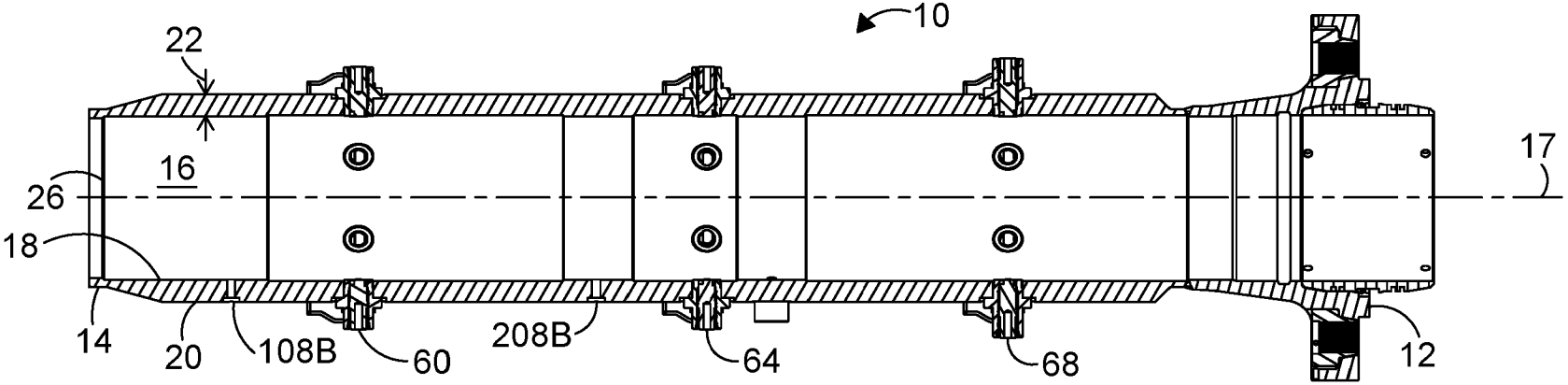

FIG. 1 shows an integration joint body 10 which in-use will be included in a riser string by means of an upper end connection 12 which will permit the integrated joint body 10 to be connected to an upper portion of the riser string, typically being the lower end of a suitable telescopic joint (not shown). Additionally, the integration joint body 10 is further provided with a lower end connection 14 which is adapted to be connected to the upper end of a suitable MPD flow spool (not shown) and which is in turn connected to a lower portion of the riser string. The telescopic joint therefore forms an upper part of the riser string such that the telescopic joint is located above the integration joint body 10 which in turn is located above the MPD flow spool within the riser string. The lower end connection 14 is suitably secured to the upper end of the MPD flow spool (not shown) by any suitable means such as welding or other suitable means such as screw threaded connection, etc.

Moreover, the integration joint body 10 comprises a through bore 16 having an inner through bore surface 18, an outer diameter surface 20 and a side wall 22 such that the integration joint body 10 is generally tubular along its longitudinal length.

The side wall 22 is generally sealed along its length such that pressurised fluids located within the integration joint body 10 and thus the rest of the riser string are safely contained by and within the side wall 22 of the integration joint body 10.

Figure 2:
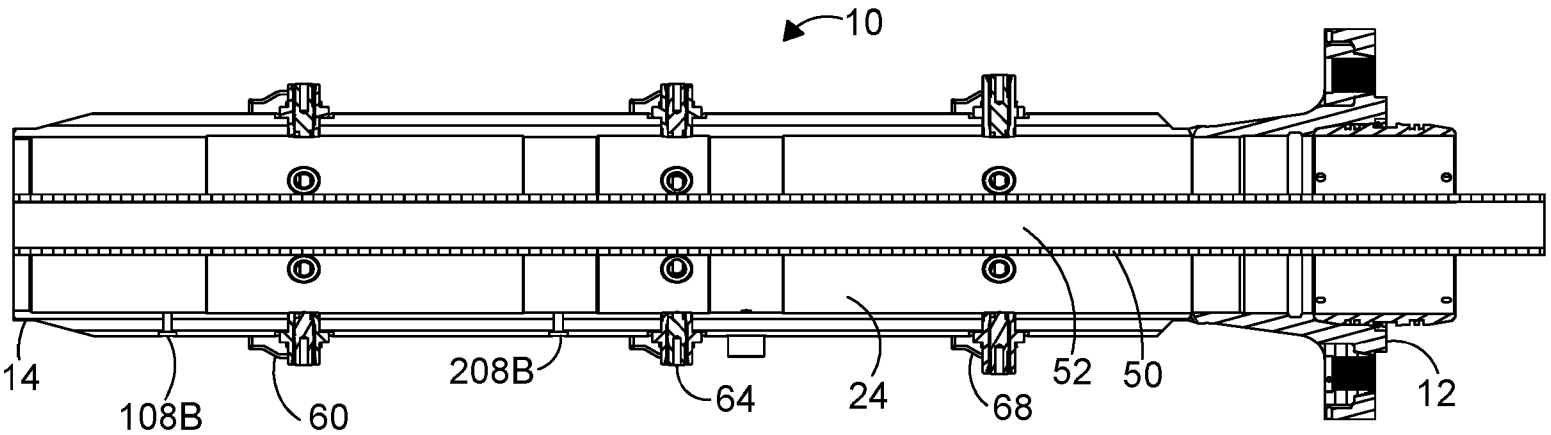

FIG. 2 shows the next stage of operation of the riser string and in particular the integration joint body 10, whereby a drill string 50 consisting of multiple lengths of drill pipe suitably connected together (and with a BHA (not shown) and a drill bit (not shown) provided at the bottom thereof) having been run or lowered through the integration joint body 10 and down through the lower portion of the riser string located below the integration joint body 10.

FIG. 2 therefore shows the configuration for conventional drilling (i.e. with no managed pressure drilling equipment being required nor operated). Accordingly, drilling operations can be conducted from the floating drilling vessel at the surface of the sea (from which the riser string is hung below), where drilling fluid or mud is pumped down through the through bore 52 of the drill string 50 and will exit the drill string 50 at the bottom thereof through the drill bit and the drilling fluid or mud plus drill cuttings will return to the surface of the floating drilling vessel via the annulus 24 located or provided between the outer surface of the drill string 50 and the inner through bore surface 18 of the integration joint body 10 (and the inner through bore surface of the rest of the riser string).

However, if MPD is required then the system shown in FIG. 2 is the starting point to enable a marine drilling riser to switch to managed pressure drilling and in order to do so, the first few joints of drill pipe are lifted up (such that the drill string is lifted up) and the first few joints of drill pipe are replaced by a running tool 54 such that the running tool 54 is now connected at the very upper end of the drill string 50.

Next, an operator attaches at least two and more preferably three sealing devices in the form of a lower packer cartridge assembly 100, with an upper packer cartridge assembly 200 located above the lower packer cartridge assembly 100 and also attaches an RCD bearing assembly 300 just above the upper packer cartridge assembly 200 to the running tool 54, such that the running tool 54 (and the drill string 50 located below it) are lowered into the through bore 16 of the integration joint body 10 such that the lower packer cartridge assembly 100, upper packer cartridge assembly 200 and RCD bearing assembly 300 are run into the through bore of the telescopic joint and rest of upper portion of the riser system and then into the through bore of the integration joint body 10 in order to form the integration joint assembly 5 in accordance with the present invention and this point in the operation is shown in FIG. 3.

Lower Packer Cartridge Assembly 100—FIG. 25*a*

The lower packer cartridge assembly 100 is shown in more detail in FIG. 25*a* and comprises a housing in the form of a lower packer cartridge body 104 being in the form of a substantially tubular body 104 and having a recess 101 provided on its inner through bore surface 105. A lower annular packer seal 102 is located in that recess 101 and a lower packer end cap 106 is securely attached to the lower end of the lower packer cartridge body 104 in order to trap the lower annular packer seal 102 within the recess 101. Accordingly, the lower annular packer seal 102 cannot move longitudinally within the recess 101 but can be forced to move radially inwardly if required (e.g. when the operator requires to activate the lower annular packer seal 102 to seal against the outer surface of the drill pipe string and thereby block the annulus at that location) by the operator pumping hydraulic fluid (from a pressurised hydraulic fluid source via lower packer hydraulic fluid extend port 108B formed through the side wall 22 of the integration joint body 10 and which is arranged to align in a sealed manner with hydraulic fluid port 108A when the lower packer cartridge assembly 100 is installed and locked in place in the integration joint body 100) into hydraulic fluid port 108A formed in the side wall of the lower packer cartridge body 104 at approximately the mid-longitudinal point of the lower annular packer seal 102.

The lower packer cartridge body 104 is further provided with a means of running in and/or retrieval in the form of a retrieval profile 110 formed therein on the inner through bore surface 105 thereof and which in use can be latched into by the running tool 54 having a suitably configured and co-operating retrieval profile 56 (seen in FIG. 3) latching into the retrieval profile 110. Suitable seals 112 such as O-ring seals 112 are provided on the outer surface of the end cap 106 such that the O-ring seals 112 act against the inner surface 105 of the lower end of the lower packer cartridge body 104 in order to prevent the hydraulic fluid from leaking out of the lower end of the lower packer cartridge assembly 100.

The lower packer cartridge assembly 100 further comprises a lock in the form of a groove 114 formed circumferentially around the outer surface of the lower packer cartridge body 104 where, in use, an operator can extend one or more keys in the form of lower packer cartridge locking dogs 60 through the side wall 22 of the integration joint body 10 into the groove 114 in order to longitudinally lock the lower packer cartridge assembly 100 in place at the lower end within the through bore 16 of the integration joint body 10 as will be described subsequently.

Lower packer cartridge seals 109 (see FIG. 25(*a*)) are provided on the outer diameter of the lower packer cartridge assembly 100 to seal against the inner diameter 18 of the integration joint body 10, to seal the annulus 24 between the outer diameter of the lower packer cartridge assembly 100 and the inner diameter 18 of the integration joint body 10 and thereby prevent any fluid in the riser string from leaking past the outer surface of the lower packer cartridge assembly 100.

Upper Packer Cartridge Assembly 200—FIG. 26*a*

The upper packer cartridge assembly 200 is broadly speaking relatively similar to the lower packer cartridge assembly 100 and thus similar components and features of the upper packer cartridge assembly 200 to those of the lower packer cartridge assembly 100 are indicated with the same reference numeral but with the addition of 100.

In general terms though, the upper packer cartridge assembly 200 is slightly longer along the longitudinal axis than the lower packer cartridge assembly 100 and the retrieval profile 210 is formed on the inner through bore surface 207 of the upper packer end cap 206 (instead of being formed on the inner through bore surface 205). In addition, the very lower end of the upper packer end cap 206 is provided with a spigot 216 which further comprises seals such as O-ring seals 217 formed about its outer circumferential surface and which is arranged to project into and therefore seal against (by means of the seals 217) against the inner surface of socket joint 118 provided at the upper end of the lower packer cartridge body 104.

Upper packer cartridge seals 209 (see FIGS. 26(*a*) and 26(*b*)) are provided on the outer diameter of the upper packer cartridge assembly 200 to seal against the inner diameter 18 of the integration joint body 10 to seal the annulus 24 between the outer diameter of the upper packer cartridge assembly 200 and the inner diameter 18 of the integration joint body 10 and thereby prevent any fluid in the riser string from leaking past the outer surface of the upper packer cartridge assembly 200.

RCD Bearing Assembly 300—FIG. 27*a*

The RCD bearing assembly 300 is best seen in FIG. 27*a* and comprises a housing in the form of an RCD bearing body 306 which is substantially tubular along its longitudinal length and which comprises a lower RCD seal 302 projecting downwards from its lower end and which is connected to the RCD bearing body 306 by a rotatable bearing 305 such that the lower RCD seal 302 can rotate about its longitudinal axis 307 (and therefore the longitudinal axis 17 of the integration joint 10) with respect to the stationary RCD bearing body 306.

The RCD bearing assembly 300 further comprises an upper RCD seal 304 arranged within a recess 303 within the RCD bearing body 306 where the upper RCD seal 304 is further connected to the RCD bearing body 306 at its upper end by means of a rotatable bearing 308 such that the upper RCD seal 304 can rotate about the longitudinal axis 307 with respect to the stationary RCD bearing body 306.

The RCD bearing assembly 300 further comprises a lock in the form of a groove or recess 314 formed circumferentially about or around the outer surface of the RCD bearing body 306 where, in use, an operator can extend one or more keys in the form of RCD assembly locking dogs 68 through the side wall 27 of the integration joint body 10 into the groove 314 in order to longitudinally lock the RCD bearing assembly 300 in place at the upper end of the through bore 16 within the integration joint body 10 as will be described subsequently.

The RCD bearing assembly 300 is further provided with a means of running in and/or retrieval in the form of a tapered retrieval surface 310 (best seen in FIG. 27(*a*)) formed therein on the lower end thereof and which in use can be seated upon and picked up by the running tool 54 having a suitably configured and co-operating tapered retrieval surface 57 (seen in FIG. 3).

RCD bearing assembly seals 317 are provided on the outer diameter of the RCD bearing assembly 300 to seal against the inner diameter 18 of the integration joint body 10 to seal the annulus 24 between the outer diameter of the RCD bearing assembly 300 and the inner diameter 18 of the integration joint body 10 and thereby prevent any fluid in the riser string from leaking past the outer surface of the RCD bearing assembly 300.

In the embodiment of the invention described with reference to FIGS. 1 to 29, the lower packer cartridge seals 109, upper packer cartridge seals 209 and RCD bearing assembly seals 317 are provided on the outer diameter of the respective assemblies 100, 200, 300. The said seals 109, 209, 317 are O-ring seals, wherein each O-ring is formed of a sufficiently resilient material, such as rubber or polyurethane, such that the O-ring may be compressed or be impinged upon by other components and then rebound sufficiently to perform the sealing function. The lower packer cartridge 100, upper packer cartridge 200, and RCD bearing assembly 300 can move either or both of axially and/or rotationally relative to the telescopic joint or integration joint body 10 preferably without damaging the O-ring or dislodging it from its desired position. This relative movement may create friction between the O-ring and a wall of the telescopic joint or integration joint body 10 but the O-ring is preferably formed of a suitable material such that the friction preferably does not damage the O-ring and the compression preferably does not hamper the ability to subsequently create a tight seal when the lower packer cartridge 100, upper packer cartridge 200 and RCD 300 are seated in their desired positions within the integration joint assembly 5, as will now be described.

Installation and Retrieval of Cartridge Assemblies 100, 200 and RCD Bearing Assembly into and from Through Bore 16 of the Integration Joint Body 10

FIG. 3 shows the running tool 54 being lowered on the drill string 50 in order to run in the lower 100, upper 200 packer cartridge assemblies and the RCD bearing assembly 300 until such a point that a seat 120 provided at the very lower most end of the lower packer cartridge assembly 100 lands on a lower most integration joint load shoulder 26, at which point the lower packer cartridge assembly 100, upper packer cartridge assembly 200, RCD bearing assembly 300 and indeed the running tool 54 can move no further down the integration joint body 10 and thus their movement is arrested and they are thus now wholly contained and individually each located co-axially within the through bore 16 of the integration joint body 10. It should be noted that this landing or load shoulder 26 as shown in FIG. 1 is a fixed shoulder on the inner diameter at the lower end of the integration joint body 10 but alternatively it could be provided by for example any other suitable means such as an additional set of retractable dogs (not shown). In any event, the lower packer cartridge assembly 100 is now located in its operative position/location within the through bore 16 of the integration joint body 10. The skilled person will note from FIGS. 3, 2 and 1 that the integration joint body 10 is provided with a series of locking dogs 60, 64, 68 formed through its side wall 22 at longitudinally spaced apart lengths along the integration joint body 10. With respect to the lower most locking dogs 60, these are arranged in use to be aligned with the groove 114 formed around the lower packer cartridge body 104, as shown in FIG. 4. The skilled person will note that in FIGS. 1, 2, 3 and 4, the various locking dogs 60, 64, 68 are arranged to be retracted such that they do not interfere with the running in of the running tool 54.

Once the lower seat 120 of the lower packer cartridge assembly 100 has landed on the load shoulder 26, the integration joint assembly 5 is complete in that it now comprises the integration joint body 10 and within its through bore are now located the lower and upper packer cartridge assemblies 100, 200 and the RCD bearing assembly 300.

Indeed, the seals 109, 209 on the outer diameter of the upper 200 and lower 100 packer cartridge assemblies are engaged on the inner diameter 18 of the integration joint body 10 and seals 317 provided on the outer diameter of the RCD bearing assembly 300 are also engaged on the inner diameter 18 of the integration joint body 10 in order to seal the annulus there between.

The upper RCD seal 304 and lower RCD seal 302 are generally formed of a resilient material such as rubber or polyurethane and in use will act as a relatively tight sealing ring through which the operator (when conducting MPD operations) will physically push the drill pipe string in order to have the drill pipe string pass through the RCD bearing assembly 300. Accordingly, the lower RCD seal 302 and upper RCD seal 304 are adapted to stretch in the radially outwards direction as the drill pipe string 50 is pushed through them and indeed are adapted to always seal via their respective inner surfaces to the outer surface of the drill pipe string up to the point where the drill pipe string is removed from within their through bore or ultimately up until the point that the upper or lower RCD seals 302, 304 fail. Moreover, because each of the upper 304 and lower 302 RCD seals are provided with their respective bearings 305, 308, the lower 302 and upper 304 RCD seals will rotate with the drill pipe string when it rotates relative to the stationary riser string and integration joint body 10.

Figure 5:
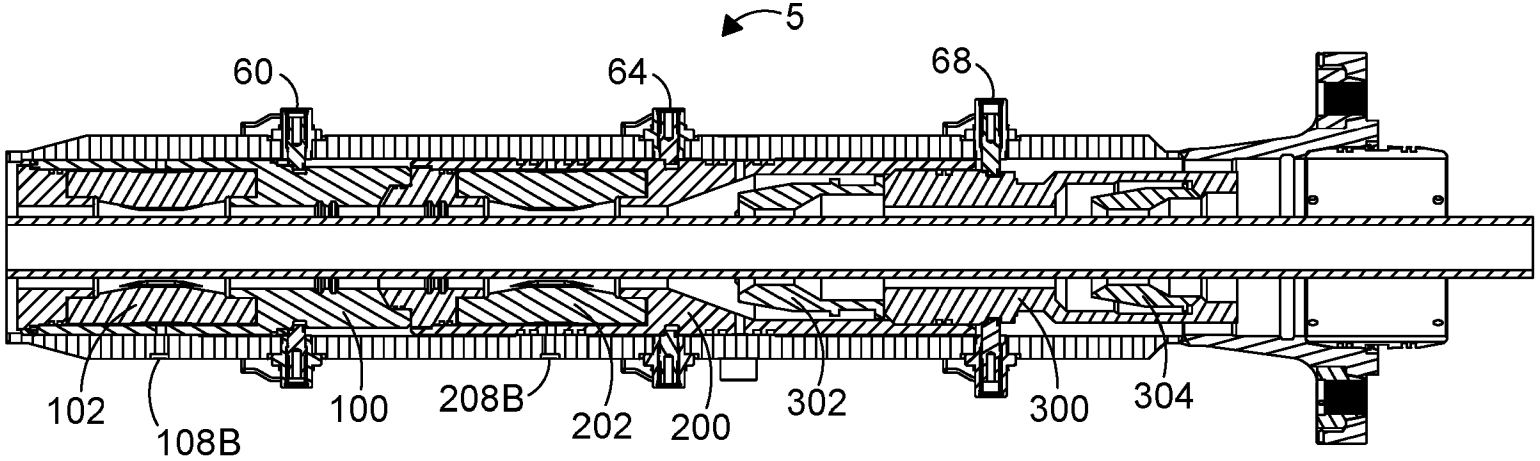

In order to prepare for MPD, the operator will lock the lower packer cartridge assembly 100, upper packer cartridge assembly 200 and RCD bearing assembly 300 in the position as shown in FIG. 5 by actuating at least the RCD assembly locking dogs 68 such that they project inwards through the side wall 22 and into the recess 314 of the RCD bearing assembly 300. In order to increase the safety factor however, the operator will also likely actuate the upper packer cartridge locking dogs 64 such that they project through the side wall 22 and into the recess 201 of the upper packer cartridge assembly 200. In addition, to further increase the safety factor, the operator will also likely actuate the lower packer cartridge locking dogs 60 such that they project through the side wall 22 and into the recess 101 of the lower packer cartridge assembly 100.

Accordingly, the integration joint assembly 5 is now in the configuration as shown in FIG. 5 and indeed is now ready to commence MPD operations. In this configuration, the lower RCD seal 302 is providing the main annular barrier to drill fluid and cuttings flowing back to surface via the goose necks of the MPD flow spool (not shown) up the annulus 24 such that the drilling fluid cannot flow past the lower RCD seal 302 and therefore the drilling fluid is forced out of the MPD flow spool located immediately below the integration joint assembly 5 in accordance with MPD operations. The upper RCD seal 304 is therefore mainly providing redundancy in case the lower RCD seal 302 fails and indeed legislation in many parts of the world requires there to be such redundancy or back up in terms of an additional or back up barrier or seal to the high pressure drilling fluid. In the arrangement shown in FIG. 5, the lower annular packer seal 102 and the upper annular packer seal 202 are not energised and therefore are deflated such that they are not sealing against the outer surface of the drill pipe string 50. However, the upper 202 and/or lower 102 annular packer seals can be actuated/energised in order to seal against the outer surface of the drill pipe string 50 and therefore to seal the annulus 24 if the operator requires/wishes that to happen particularly if for example the operator wishes to pull/change out the RCD bearing assembly 300 and such an operation is shown in FIGS. 6-8; the operator could then run in a new RCD bearing assembly 300 on a suitable running tool.

Figure 6:
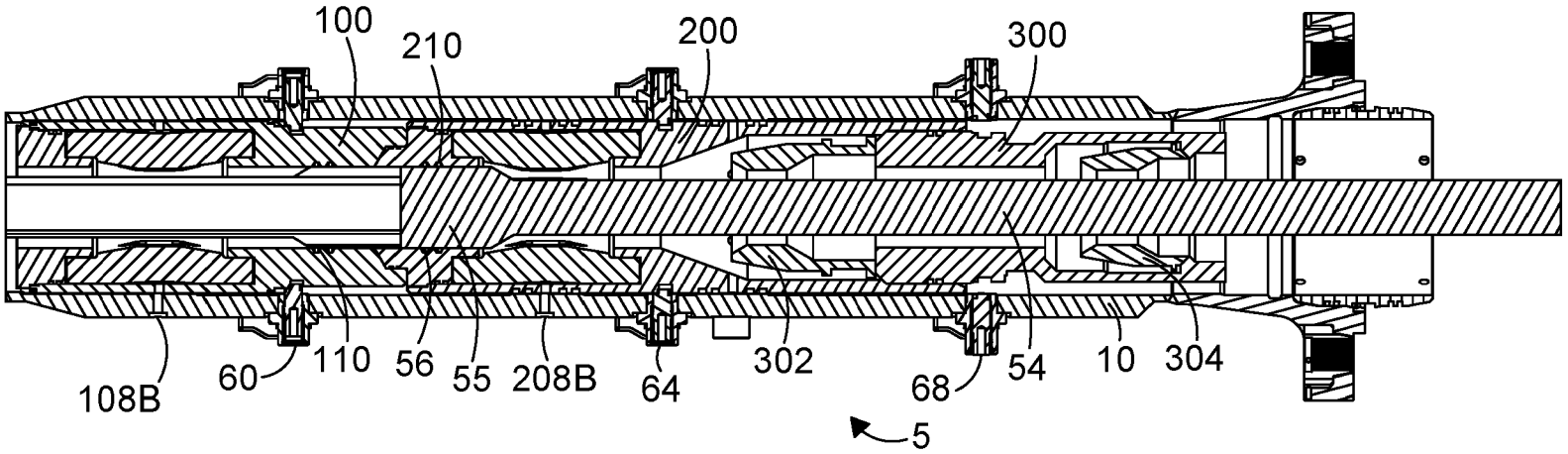
Figure 7:
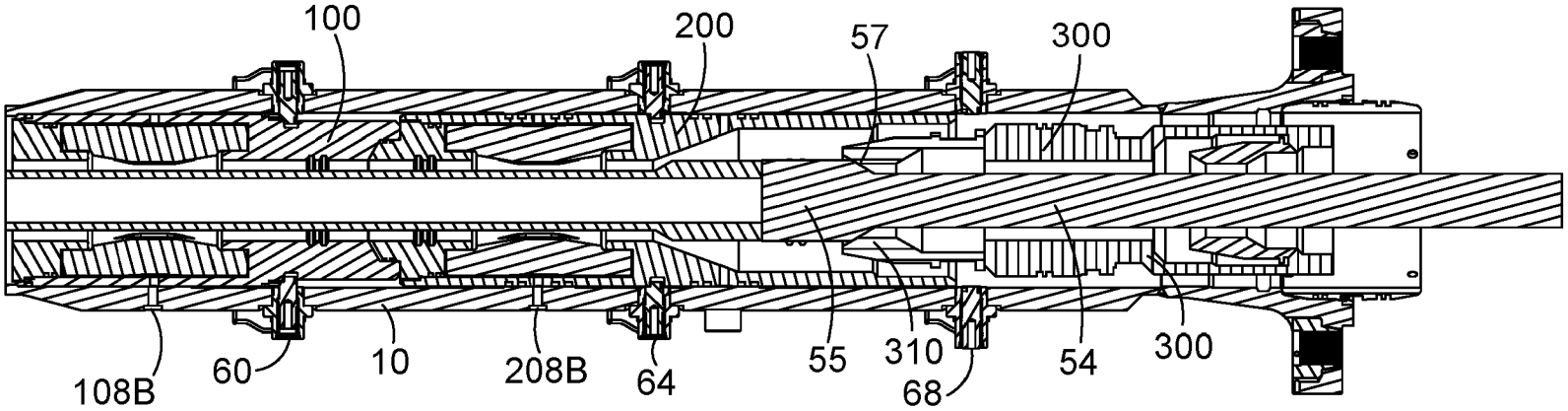

FIG. 6 therefore shows the start of an operation to change out the RCD bearing assembly 300 on its own (with both the upper 200 and lower 100 packer cartridges being left locked in place in the through bore of the integration joint body 10). In order the start such an operation as shown in FIG. 6, the RCD bearing assembly locking dogs 68 are retracted and this can be done whilst maintain full sealing operation of the energised upper 202 and/or lower 102 annular packer seals. Accordingly, as shown in FIG. 6, the running/retrieval tool 54 is run down into the integration joint body 10 until its enlarged lower end 55 passes and squeezes firstly through the upper RCD seal 304 and then through the lower RCD seal 302. The RCD assembly locking dogs 68 are then retracted from their locking engagement with the groove or recess 314 by remote actuation thereof by the operator and this position is now shown in FIG. 6. FIG. 7 shows the RCD bearing assembly 300 as having been unseated from the upper packer cartridge assembly 200. It should also be noted that the RCD bearing assembly 300 can be lifted either using the dedicated running/retrieval tool 54 or indeed could be lifted back to the floating vessel (not shown) at the surface using the drill pipe collar because the lower RCD seal 302 and indeed the upper RCD seal 304 will seat against the upper surface of a drill pipe collar and because the RCD bearing assembly 300 is unlatched, only the weight of the RCD bearing assembly 300 need be overcome in order to lift the RCD bearing assembly 300 back to the surface through the through bore of the riser string. In any event, the running/retrieval tool 54 is then picked back up until the enlarged lower end 55 seats up against the lower end of the lower RCD seal 302. Because the RCD bearing assembly 300 is no longer locked in place (because the RCD assembly locking dogs 68 have been retracted) the enlarged lower end 55 therefore picks up the RCD bearing assembly 300 and further lifting of the running/retrieval tool 54 will raise the RCD bearing assembly 300 upwards until it exits the upper end of the through bore 16 of the integration joint body 10 and further lifting will lift it through the through bore of the telescopic joint located above the integration joint body 10 until the RCD bearing assembly 300 can be removed from the running/retrieval tool 54 by the operator at the surface of the moon pool (not shown). FIG. 8 shows the RCD bearing assembly 300 as having exited the through bore 16 of the integration joint body 10. At this point, the upper 202 and/or lower 102 annular packer seal(s) can continue to be energised or can be de-energised after the RCD bearing assembly 300 has been removed depending on operational requirements and in particular if MPD is concluded, the lower 100 and upper 200 packer cartridge assemblies can be de-energised and pulled from the integration joint body 10 as is now shown in FIGS. 9-16.

Figure 8:
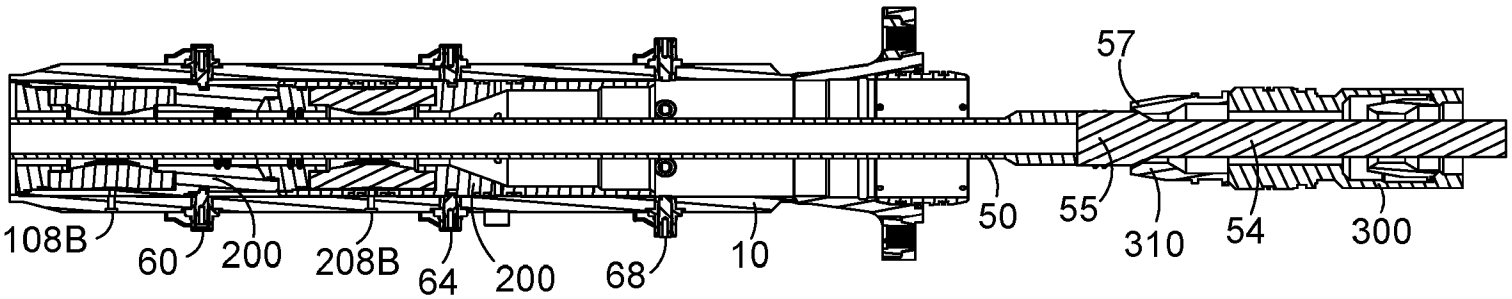
Figure 9:
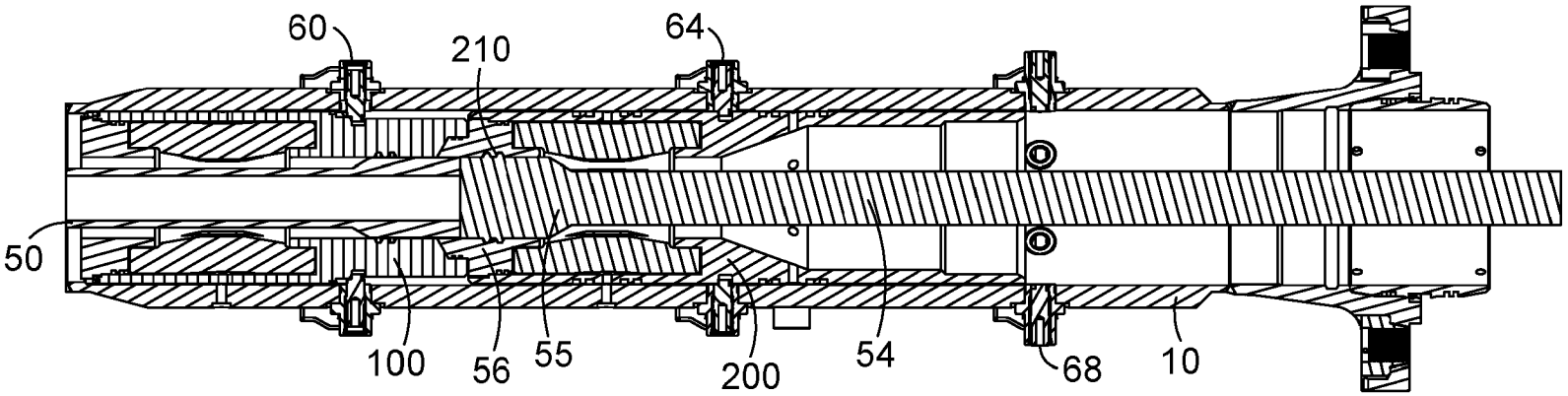

FIG. 9 shows the next stage of operations on from that of FIG. 8 if the operator wishes to remove the upper packer cartridge assembly 200. In such a case, the operator attaches a suitable running/retrieval tool 54 having a suitably shaped retrieval profile 56 arranged to co-operate and engage with the retrieval profile 210 formed on the inner through bore 207 of the upper packer cartridge assembly 200. The running/retrieval tool 54 is run initially through the through bore of the telescopic joint (not shown) positioned immediately above the integration joint assembly 5 and into the through bore of the integration joint body 10 and can be run in on the upper end of the drill pipe string 50. The running tool 54 is run in until it locks onto the retrieval groove profile 210 of the upper packer cartridge assembly 200. This stage is shown in FIG. 9.

Figure 10:
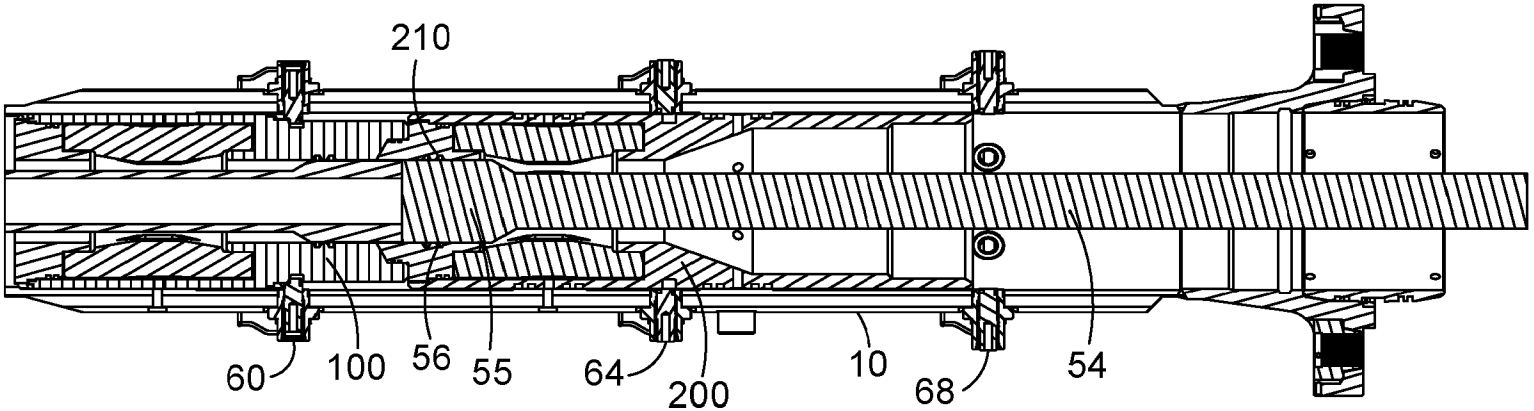
FIG. 10 shows the next stage of operation on from that of FIG. 9 of the retrieval of the upper annular packer seal, where the upper packer cartridge locking dogs have been retracted.

The operator then remotely actuates the upper packer cartridge locking dogs 68 in order to retract them from engagement with the groove 214 such that the upper packer cartridge assembly 200 is no longer locked in place within the integration joint body 10 and this stage is shown in FIG. 10. It should be noted that the unlocking of the upper packer cartridge assembly 200 can be achieved whilst maintaining full operation of the lower packer cartridge assembly 100 and the lower packer cartridge assembly 100 may be energised/de-energised during this process depending on the operational requirements of the operator.

Figure 11:
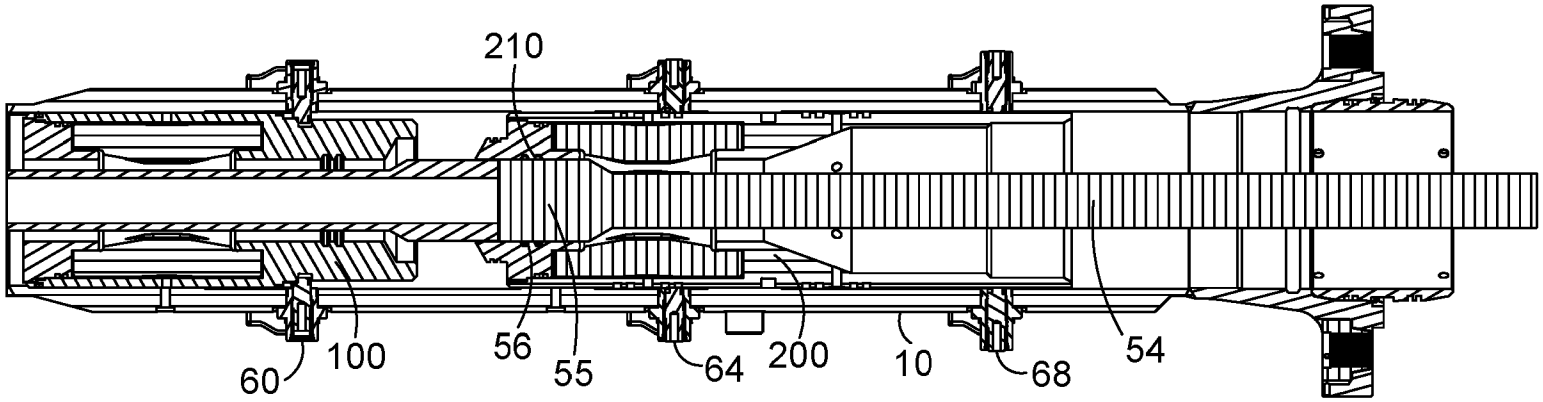
FIG. 11 shows the next stage on from that of FIG. 10 of the retrieval of the upper annular packer seal where the upper annular packer seal cartridge has been unseated and lifted from the lower annular packer seal cartridge (the latter of which remains in place and which remains energised in order to provide an annular seal)

FIG. 11 shows the next stage of the operation to remove the upper packer cartridge assembly 200, whereby the upper packer cartridge assembly 200 is unseated from the lower packer cartridge assembly 100 by pulling the drill pipe string 50 upwards to thereby lift and raise the retrieval tool 54 and thus the upper packer cartridge assembly 200 upwards.

Figure 12:
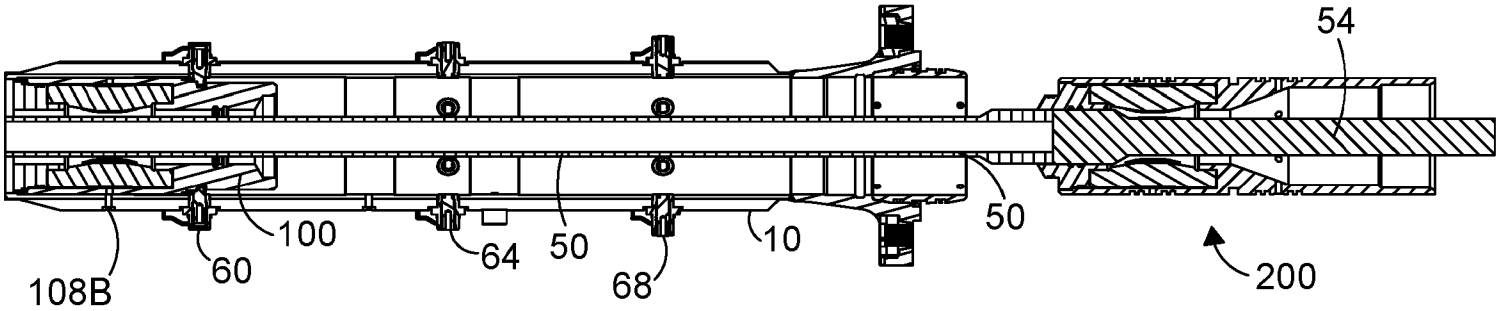
FIG. 12 shows the next stage on from that of FIG. 11 of the retrieval of the upper annular packer seal, where the upper annular packer seal has been pulled out of the through bore of the integration joint body.

FIG. 12 shows the next stage whereby the upper packer cartridge assembly 200 has been lifted up and out of the through bore 16 of the integration joint body 10 such that it will pass through the telescopic joint (not shown) and up to the drill floor of the marine vessel located above the riser string.

If the operator wishes to remove the lower packer cartridge assembly 100, the retrieval tool 54 is once again run down into the integration joint body 10 on the drill string 50 at the top thereof such that it is run through the telescopic joint (not shown) and into the integration joint body 10. The retrieval tool 54 is moved sufficiently downwards such that its retrieval profile 56 is moved into alignment with the retrieval profile 110 formed by the grooves provided on the inner surface of the through bore 105 of the lower packer cartridge body 104 until the respective profiles 56, 110 are in locking engagement with one another. It should be noted that the retrieval tool 54 and retrieval profile 56 could be the same retrieval tool 54 and retrieval profile 56 that were used to retrieve the upper packer cartridge assembly 200 although it may be that they could be different if operational requirements would find that beneficial. This point in the operation is shown in FIG. 13.

Figure 13:
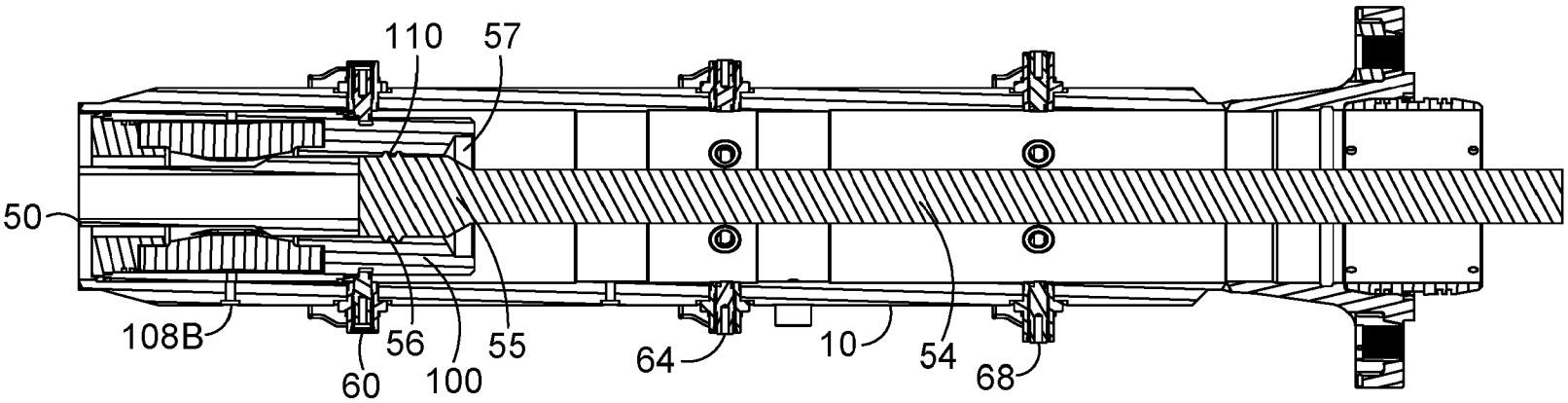
FIG. 13 shows a next stage on from that of FIG. 12 where this next stage is conducted if the lower annular packer seal requires to be replaced, in which case the retrieval tool is run into the through bore of the integration joint body again until the retrieval tool locks into the retrieval profile of the lower annular packer seal.
Figure 14:
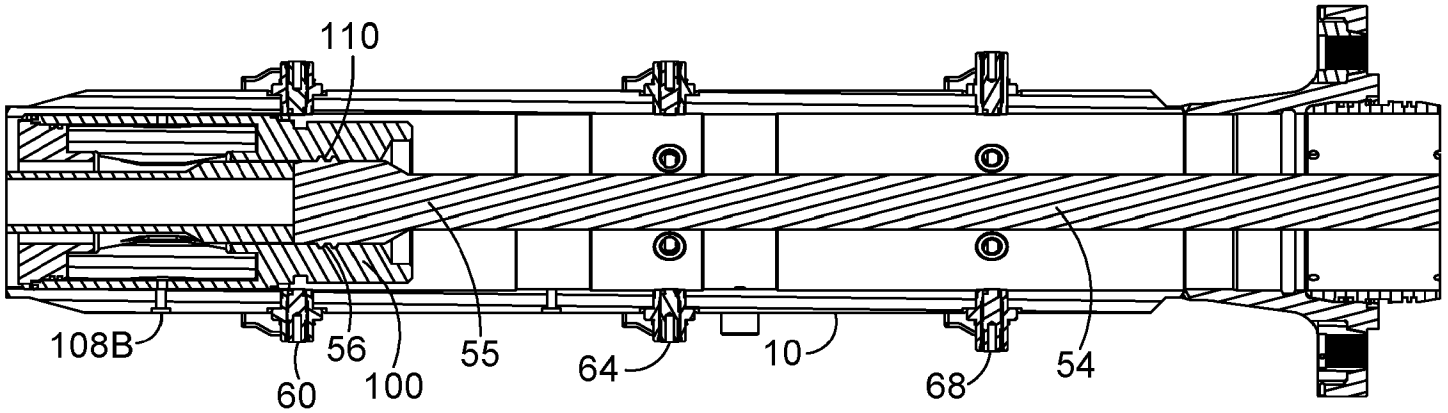
FIG. 14 shows the next stage on from that of FIG. 13 of the retrieval of the lower annular packer seal, where the lower packer cartridge locking dogs of the integration joint have been retracted such that the lower annular packer seal cartridge can now be retrieved and pulled out of the through bore of the integration joint body through bore by the retrieval tool.
Figure 15:
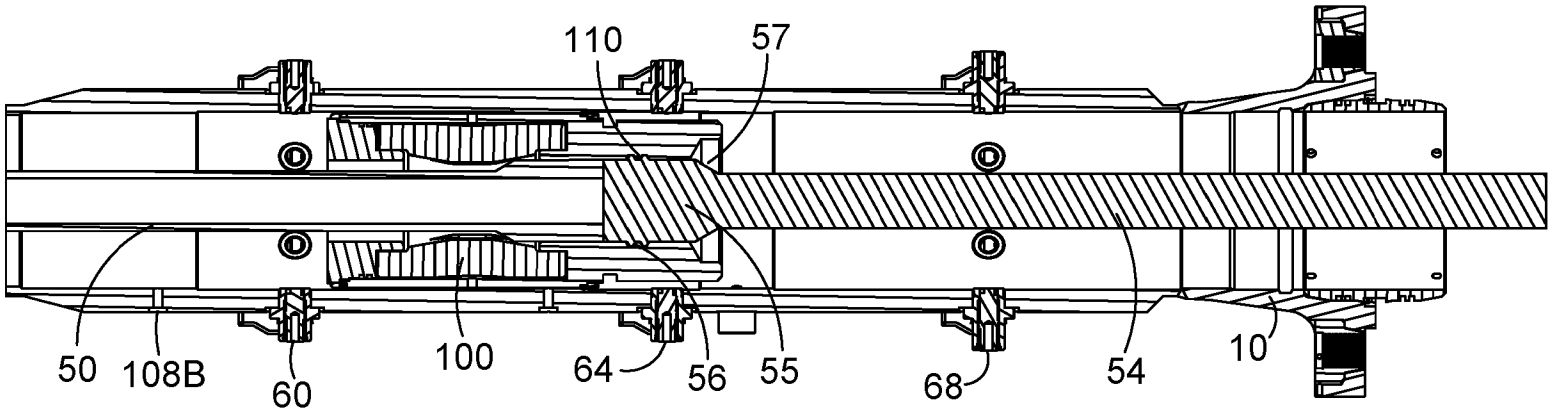
FIG. 15 shows the next stage on from that of FIG. 14 of the retrieval of the lower annular packer seal, where the retrieval tool has been lifted partly out of the through bore of the integration joint body.

FIG. 14 shows the next stage on from that of FIG. 13, whereby the lower packer cartridge locking dogs 60 have been retracted by the operator remotely actuating them to move them back through the side wall 22 of the integration joint body 10 such that they are no longer in engagement with the recess 114 provided in the lower packer cartridge body 104. Thus, the lower packer cartridge assembly 100 is no longer locked in place within the integration joint body 10 by the lower packer cartridge locking dogs 60 and thus the lower packer cartridge assembly 100 can be unseated from the integration joint body 10 by pulling the drill pipe string 50 upwards in order to pull the retrieval tool 54 upwards and this stage in the operation is shown in FIG. 15.

Figure 16:
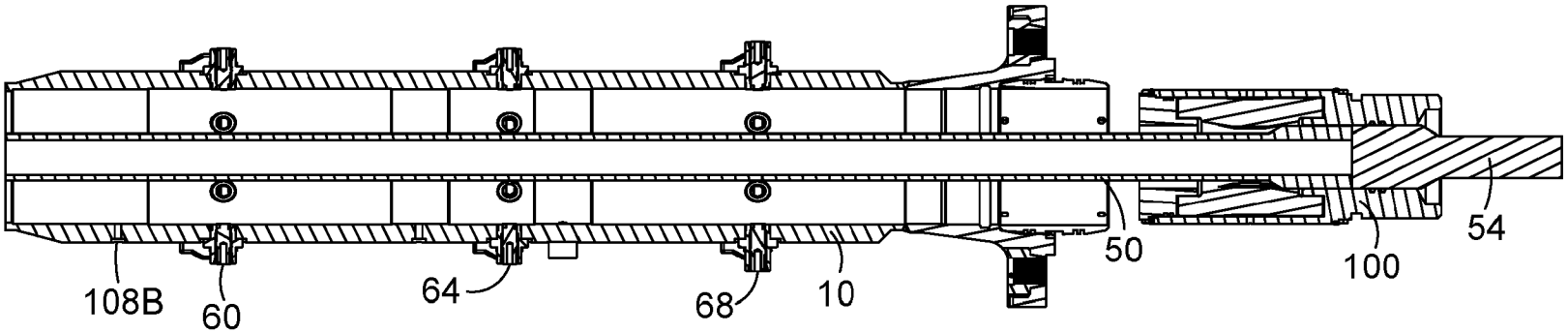
FIG. 16 shows the next stage on from that of FIG. 15 of the retrieval of the lower annular packer seal, where the lower annular packer seal has been lifted and pulled out of the through bore of the integration joint body and therefore at this stage there is no annular seal acting within the annulus of the integration joint body.

Continued lifting of the drill pipe string and retrieval tool 54 lifts the lower packer cartridge assembly 100 out of the through bore 16 of the integration joint body 10 and through the telescopic joint (not shown) to the surface. This stage in the operation is shown in FIG. 16.

Figure 17:
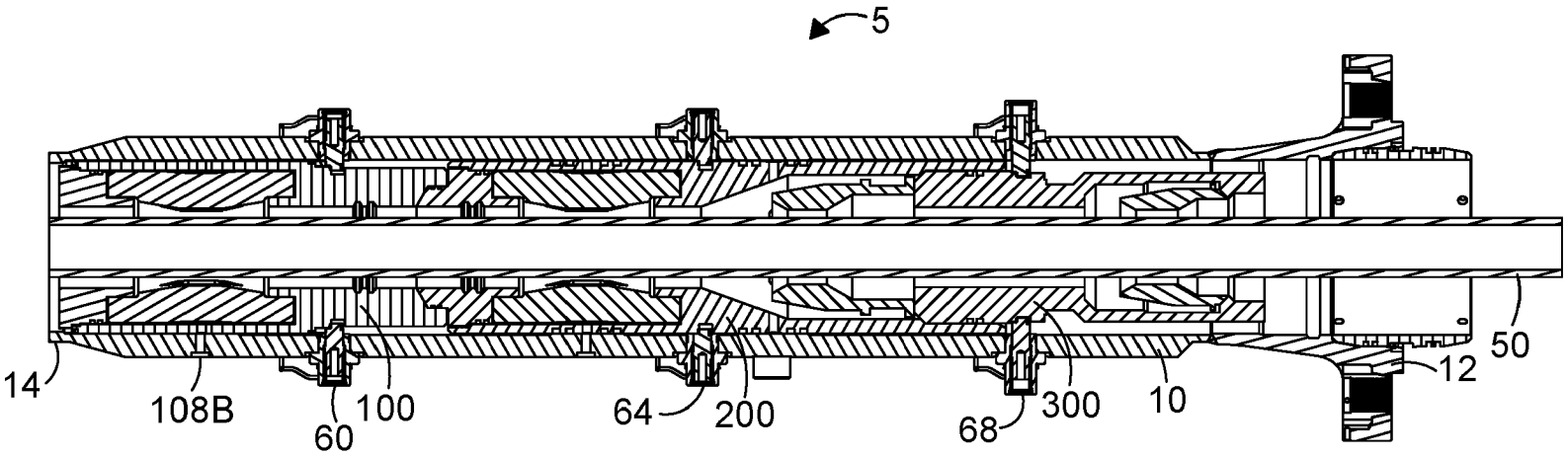
FIG. 17 shows that, following on from the stage of FIG. 16, the stages of FIG. 3 through FIG. 5 have been repeated in order to reinstall a new lower annular packer seal, upper annular packer seal and new RCD bearing assembly into the through bore of the integration joint body.

If the operator wishes, the operator can repeat the stages shown in FIGS. 3-5 in order to reinstall new upper 200 and lower 100 packer cartridge assemblies and a new RCD bearing assembly 300 in order to reinstall them into the through bore 16 of the integration joint body 10. Indeed, FIG. 17 shows the RCD bearing assembly 300, upper packer cartridge assembly 200 and lower packer cartridge assembly 100 as having been reinstalled following the steps of FIG. 3-5.

In addition, embodiments of the present invention have additional flexibility in that it is possible to remove different combinations of the RCD bearing assembly 300 and the upper 200 and lower 100 packer cartridge assemblies depending upon operational requirements.

For example, the operator can decide to remove the RCD bearing assembly 300 and the upper packer cartridge assembly 200 as one unit by running the retrieval tool 54 from the surface down through the telescopic joint and into the through bore 16 of the integration joint body 10. The operator can arrange the running/retrieval tool 54 to lock into the grooved recessed profile on the inner diameter surface 205 of the upper packer cartridge assembly 200 and this stage of the operation is shown in FIG. 18.

The operator will then remotely unlock the RCD assembly locking dogs 68 by retracting them through the side wall 22 and will also instruct the upper packer cartridge locking dogs 64 to retract again by withdrawing them back through the side wall 22 such that the RCD bearing assembly 300 and the upper packer cartridge assembly 200 are now unlocked with respect to the integration joint body 10. It should be noted that this unlocking can be achieved whilst fully maintaining operation of the lower packer cartridge assembly 100. Moreover, the lower packer cartridge assembly 100 may be energised or de-energised during this stage as shown in FIG. 19 depending on the operational requirements of the operator. FIG. 20 shows the next stage on from FIG. 19 where the upper packer cartridge assembly 200 and the RCD bearing assembly 300 are unseated from the lower packer cartridge assembly 100 by pulling up the retrieval tool 54 and drill string 50. FIG. 21 shows the continued pulling of the retrieval tool 54 and thus the upper packer cartridge assembly 200 and RCD bearing assembly 300 up out of the through bore 16 of the integration joint body 10 and through the telescopic joint (not shown) to the surface of the riser string such that the operator can then remove the retrieval tool 54 from the drill string 50. FIG. 22 shows a new upper packer cartridge assembly 200 and RCD bearing assembly 300 having been run into the through bore 16 of the integration joint body 10 on the running/retrieval tool 54 until the upper packer cartridge assembly 200 lands on the upper end of the lower packer cartridge assembly 100. The running/retrieval tool 54 does this by locking its profile 56 to the running/retrieval profile 210 of the upper packer cartridge assembly 200 and running both the running/retrieval tool 54 and the RCD bearing assembly 300 and upper packer cartridge assembly 200 through the through bore of the telescopic joint (not shown) into the through bore 16 of the integration joint body 10. At this point, as shown in FIG. 22, the RCD assembly locking dogs 68 and the upper packer cartridge locking dogs 64 are retracted in order not to impede the progress of the RCD bearing assembly 300 and upper packer cartridge assembly 200 into the through bore 16 of the integration joint body 10. FIG. 23 shows the next stage on from that of FIG. 22 in that the upper packer cartridge assembly 200 has landed on the upper end of the lower packer cartridge assembly 100 and the upper packer cartridge locking dogs 64 are actuated such that they extend into the recess groove 214 (such that the upper packer cartridge assembly 200 is locked in place within the through bore 16 of the integration joint body 10) and the RCD assembly locking dogs 68 are also actuated such that they extend through the side wall 22 of the integration joint body 10 and into the recessed groove 314 formed on the outer surface around the circumference of the RCD bearing body 306 such that the RCD bearing assembly 300 is locked in place within the through bore 16 of the integration joint body 10.

FIG. 24 shows the next stage on from that of FIG. 23 where the running tool 54 has been withdrawn up through the integration joint assembly 5 and further up through the telescopic joint (not shown) located immediately above the integration joint assembly 5 and back to the surface, such that the operator can now commence MPD again should they wish.

FIG. 28 shows for clarity purposes another view of the integration joint assembly 5 with the lower packer cartridge assembly 100, upper packer cartridge assembly 200 and RCD bearing assembly 300 all locked in place in the through bore 16 thereof by the respective locking dogs 60, 64, 68 but without the drill string 50 passing there through.

FIG. 29 again shows the integration joint assembly 5 with the lower 100 and upper 200 packer cartridge assemblies and also the RCD bearing assembly 300 locked in place by their respective locking dogs 60, 64, 68 but also shows the drill string 50 passing through the through bore 16 of the integration joint assembly 5 but also shows that the lower annular packer seal 102 has been energised 102*e* as has the upper annular packer seal 202*e* by having hydraulic fluid pumped into the outer surface thereof from the lower 108B and upper 208B packer hydraulic fluid extend ports which are aligned with the respective set of hydraulic ports 108A, 208A such that the lower 102*e* and upper 202*e* energised annular packer seals 102, 202 are sealing against the outer surface of the drill string 50 and therefore are providing a seal within the annulus 24 of the integration joint body 10 and thus the riser string.

In addition, seals are provided 109, 209 on the outer diameter of the upper 200 and lower 100 packer cartridge assemblies which respectively seal on the inner diameter of the integration joint body 10 and prevent any fluid in the riser string from leaking past the respective upper 200 and lower 100 packer cartridge assemblies.

Furthermore, seals 317 are provided on the outer diameter of the RCD bearing assembly 300 and which seal on the inner diameter of the upper packer cartridge assembly 200.

Additional components and equipment can be added to embodiments of the integration joint assembly 5 as required such as auxiliary lines (e.g. choke and kill lines) etc. without departing from the present invention.

Embodiments of the present invention have the great advantage over conventional integration joints that the integration joint assembly 5 is much shorter in length than conventional integration joints and therefore, in use, the goose necks of the MPD flow spool will be much higher up the riser string and therefore are closer to the moon pool of the surface vessel thus allowing the operator much easier access to the drilling fluid return hoses that are connected to the goose necks of the MPD flow spool. In addition, whilst the integration joint assembly 5 can be and is intended for managed pressure drilling, it can additionally be used for gas handling (in which case the RCD bearing assembly 300 is not required).

It should also be noted that where the integration joint assembly 5 is not used in a floating rig application, the integration joint assembly 5 would not need to be located in line below the telescopic joint but for floating rig applications such as a semi-submersible or drill ship, the integration joint assembly 5 is typically located within the riser string below the telescopic joint (not shown).

Embodiments of the present invention also have the advantage that instead of pressurised hydraulic fluid being pumped into the cavity behind each of the lower 102 and upper 202 annular packer seals, pressurised gas could instead be pumped into that cavity via the respective hydraulic port 108A, 208A from the respective lower 108B and upper 208B packer hydraulic fluid extend ports.

The lower 100 and upper 200 packer cartridge assemblies can be used for a wide range of scenarios such as, but not limited to:—

- sealing on the drill pipe string 50 when the RCD bearing assembly 300 seals 302, 304 fail;
- as a back up to the RCD bearing assembly 300;
- for stripping drill pipe from the drill pipe string 50 when removing/replacing the RCD bearing assembly 300; or
- for gas handling.

Accordingly, embodiments of the present invention have the advantage that the whole riser string does not need to be decommissioned out of active (i.e. pressurised) service if the RCD bearing assembly 300 needs to be replaced because the lower 100 and/or upper 200 packer cartridge assemblies can be actuated to seal their respective seal against the drill pipe string 50, unlike for example the prior art replaceable rotatable bearing system 40 shown in US Patent Publication No. US2012/0085545.

Embodiments of the present invention have the further advantage that the upper 202 and lower 102 annular packer seals are housed within separate cartridges 200, 100 and these cartridges 100, 200 are retrievable separately or can be retrieved together from the through bore 16. In addition, the upper packer cartridge 200 is additionally designed to have the RCD bearing assembly 300 landed and housed thereon and this therefore allows the RCD bearing assembly 300 to land and seal on the upper packer cartridge assembly 200 and this feature also allows both the upper packer cartridge assembly 200 and RCD bearing assembly 300 to be run/retrieved from the through bore 16 through the riser string as one unit if desired.

Embodiments of the present invention have the further advantage that the upper and lower packer cartridge assemblies 200, 100 provide redundancy and the ability to change the upper packer cartridge assembly 200 whilst maintaining the lower packer assembly 100 functionality. It would be possible however that modifications could be made to the integration joint assembly 5 in order to have further packer seals or indeed just one packer seal such as that 102 contained in the lower packer cartridge assembly 100.

The RCD bearing assembly 300 can be retrieved from the through bore 16 whilst maintaining the functionality of both the lower 100 and upper 200 packer cartridge assemblies and the cartridge assemblies 100, 200 can remain locked in place in the through bore 16 during removal and replacement of the RCD bearing assembly 300.

The embodiments of the present invention have the further advantage that the upper packer cartridge 200 can be retrieved whilst maintaining the functionality of the lower packer cartridge assembly 100 which can remain locked in place within the through bore 16 of the integration joint body 10. In addition, the upper 200 and lower 100 packer cartridge assemblies can be retrieved collectively if desired or alternatively the upper packer cartridge assembly 200 can be retrieved on its own by the operator.

The locking dogs 60, 64, 68 are incorporated into the integration joint body 10 to independently lock the RCD bearing assembly 300, upper packer cartridge assembly 200 and lower packer cartridge assembly 100 and these locking dogs, 60, 64, 68 are hydraulically driven and extend radially inwards to lock on to their respective locking grooves 314 in the RCD bearing assembly 300 and groove 214 in the upper packer cartridge assembly and locking groove 114 in the lower packer cartridge assembly 100. Moreover, the locking dogs 60, 64, 68 can function independently or in any combination thereof and thus permit independent locking and unlocking for each of the RCD bearing assembly 300, upper packer cartridge assembly 200 and lower packer cartridge assembly 100.

In addition, the embodiments of the present invention have the advantage that the upper packer cartridge assembly 200 lands on the lower packer cartridge assembly 100 when being installed separately and the upper packer cartridge assembly 200 comprises seals 217 which seal against the inner surface of the socket joint 118 once landed in the lower packer cartridge assembly 100.

Embodiments of the present invention have the yet further and important advantage that any one, two or three of the RCD bearing assembly 300, upper 200 and lower 100 packer cartridge assemblies can be replaced by running them through the through bore of the riser string from and into the through bore 16 without having to dismantle the riser string and that advantage will provide very significant benefits to an operator.

Moreover, the ability of each set of locking dogs 60, 64, 68 to be operated independently from one another in order to provide an independent and separable lockable ability for each of the: —lower packer cartridge assembly 100;

upper packer cartridge assembly 200; and

RCD bearing assembly 300 means that each assembly 100, 200, 300 can be separably lockable and this provides the further advantage that one or two of them e.g. the lower packer cartridge assembly 100 on its own or both the lower 100 and upper 200 packer cartridge assemblies can be locked in placed and can therefore provide sealing capability whilst e.g. the upper packer cartridge assembly 200 and/or the RCD bearing assembly 300 can be retrieved and replaced if needs be from the through bore 16 of the integration joint body 10.

Modifications and improvements may be made to the embodiments herein before described without departing from the scope of the invention.

For example, the RCD bearing assembly 300 could be modified to only have one of the upper 304 or lower 302 RCD seals but it is much preferred to have two such seals for redundancy purposes and indeed many jurisdictions around the world require two such seals due to the potentially high pressure of the drilling fluid to be sealed.

In addition, the locking dogs 60, 64, 68 could be replaced by any suitable locking arrangement although a remote locking arrangement would be preferred.

The invention claimed is:

1. An integration joint assembly for use in drilling operations, the integration joint assembly comprising;

an integration joint body comprising;

an inner through bore;

an upper end adapted for connection with an upper portion of a riser system;

and a lower end adapted for connection with a lower portion of a riser system;

the integration joint assembly being adapted to permit a tubular work string to pass there through such that there is an annulus created between the inner through bore of the integration joint body and the outer surface of the tubular work string;

wherein the integration joint assembly further comprises at least two sealing devices adapted in use to provide a seal within the said annulus;

wherein the said at least two sealing devices and the integration joint body are adapted such that the said at least two sealing devices are capable of being located within the inner through bore of the integration joint body;

wherein, each of the said at least two sealing devices are capable of being locked within the inner through bore of the integration joint body by at least two locking devices and wherein each of the at least two sealing devices comprise their own respective locking device; and wherein each of the said at least two sealing devices can be separately locked and unlocked as required by actuation of their own respective locking device in such a manner to permit one of the sealing devices to be locked within the inner through bore and at least one of the at least two sealing devices to be run into and/or retrieved from the inner through bore of the integration joint body.

2. The integration joint assembly according to claim 1, wherein each of the said at least two sealing devices comprises its own respective housing and at least one seal mounted within said housing.

3. The integration joint assembly according to claim 1, wherein each of the said at least two sealing devices comprises a retrieval means to permit running in and/or retrieval of the respective each of the said at least two sealing devices.

4. The integration joint assembly according to claim 2, wherein each housing comprises a locking means into which a respective said locking device is engageable in order to lock said housing of said respective sealing device within the inner through bore of the integration joint body.

5. The integration joint assembly of claim 4, wherein each said locking device is mounted on the integration joint body and each said locking device comprises one or more radially moveable dog members which can be moved radially inwardly to project inwardly from an inner surface of the integration joint body and into the said locking means of the respective sealing device, wherein each said locking device can be actuated between a radially inwardly projecting configuration and a retracted configuration such that they do not project into said locking means of the respective sealing device.

6. The integration joint assembly of claim 1, wherein the at least two sealing devices comprise:— a rotation control device (RCD) comprising a housing and two longitudinally spaced apart seals rotatably mounted within said housing by a respective bearing mechanism; and at least one annular seal device;

wherein at least one of the rotation control device and the annular seal device are adapted to be located within the inner through bore of the integration joint body.

7. The integration joint assembly of claim 6, wherein the integration joint body is adapted to house both a rotation control device (RCD) and two annular seal devices within its inner through bore, and the two annular seal devices are arranged in series/in line along the longitudinal length of the integration joint body.

8. The integration joint assembly of claim 6, wherein at least one of the rotation control device and the annular seal device can be run into the inner through bore of the integration joint body through the upper portion of the riser system which houses a telescopic joint, and locked to the integration joint body within the inner through bore of the integration joint body.

9. The integration joint assembly of claim 6, wherein the at least one of the rotation control device and the annular seal device is capable of being retrieved from the inner through bore of the integration joint body by pulling the at least one of the rotational control device and the annular seal device upwards through the inner through bore of the integration joint body and further pulling the at least one of the rotational control device and the annular seal device upwards through a through bore of the upper portion of the riser system.

10. The integration joint assembly of claim 6, wherein the integration joint assembly further comprises both of the rotation control device and the at least one annular seal device, wherein the rotation control device is arranged to be located above the at least one annular seal device within the inner through bore of the integration joint body.

11. The integration joint assembly of claim 10, wherein the at least one annular seal device comprises two annular seal devices, wherein the two annular seal devices are an upper annular seal device and a lower annular seal device.

12. The integration joint assembly of claim 6, wherein the rotational control device can be retrieved and run into the inner through bore of the integration joint body independently of an annular seal device.

13. The integration joint assembly of claim 6, wherein the rotational control device can be retrieved and run into the inner through bore of the integration joint body with at least one annular seal device.

14. The integration joint assembly of claim 6, wherein one or both of the rotation control device and the at least one annular seal device can be located within the inner through bore of the integration joint body of and locked to the integration joint body when the integration joint body is installed within the riser system.

15. The integration joint assembly of claim 6, wherein one or both of the rotation control device and the at least one annular seal device can be run into the inner through bore of the integration joint body through a through bore of the upper portion of the riser system and can be locked to the integration joint body within the inner through bore of the integration joint body after the integration joint body has been installed within the riser system.

16. The integration joint assembly of claim 6, wherein the integration joint assembly further comprises seals positioned between an outer surface of the RCD and the inner through bore of the integration joint body, wherein the seals are provided on and/or around the outer surface of the RCD such that they act to seal a gap between the outer surface of the RCD and the inner through bore of the integration joint body.

17. The integration joint assembly of claim 6, wherein the integration joint assembly further comprises seals positioned between an outer surface of the said at least one annular seal device and the inner through bore of the integration joint body wherein the seals are provided on and/or around the outer surface of the said at least one annular seal device such that they act to seal a gap between the outer surface of the said at least one annular seal device and the inner through bore of the integration joint body.

18. The integration joint assembly of claim 6, wherein the integration joint body further comprises a formation formed on the inner through bore of the integration joint body to prevent the rotation control device and the one or more annular seal devices from moving any lower through the integration joint body than the formation.

19. The integration joint assembly of claim 6, wherein each annular seal device comprises an in use de-energised or deflated inner diameter which is greater than an outer diameter of the tubular work string which passes there through such that when each of the said annular seal devices in use is de-energised it allows the free movement of the tubular work string there through and therefore does not impede the movement there through and therefore does not seal against the outer surface of the tubular work string wherein each of the said annular seal devices further comprise an in use energised or inflated inner diameter which is smaller than the outer diameter of the tubular work string which passes there through such that when each of the said annular seal devices in use is energised it seals against the outer surface of the tubular work string and therefore does not permit drilling fluid located in the annulus to pass through the annular seal device in the upwards direction from downhole to up-hole.

20. The integration joint assembly of claim 19, wherein each annular seal device can be selectively energised or de-energised by the respective introduction or removal of fluid from a cavity in fluid communication with a surface of the said annular seal device, wherein said cavity is in fluid communication with an outer surface of the said annular seal device such that when fluid is pumped into said cavity, the said annular seal device is forced inwards into contact with the tubular work string passing through the integration joint body to thereby form a seal in the annulus between the outer surface of the tubular work string and the inner through bore of the integration joint body.

21. A method of drilling comprising:

installing an integration joint assembly according to claim 1 in a riser system; and running a tubular work string through the inner through bore thereof.

22. The method of claim 21 wherein an annulus is created between the inner through bore of the integration joint body and the outer surface of the tubular work string; and further comprising locating at least one sealing device within the inner through bore of the integration joint body, wherein the at least one sealing device is capable of sealing the said annulus.

23. The method of claim 22, further comprising wholly locating the sealing device co-axially within the inner through bore of the integration joint body.

24. The method of claim 21, further comprising:

locating at least one of a rotating control device and an annular seal device into the inner through bore of the integration joint body; and locking the rotating control device or annular seal device within the inner through bore of the integration joint body.

25. The method of claim 24, further comprising:

unlocking and retrieving the said rotating control device or annular seal device from the inner through bore of the integration joint body.

26. The method of claim 25, wherein the retrieving step further comprises:

pulling the rotating control device or annular seal device upwards through the inner through bore of the integration joint body; and pulling the rotating control device or annular seal device upwards through a through bore of the upper portion of the riser system.

27. The method of claim 24, further comprising locating the rotating control device above the at least one annular seal device within the inner through bore of the integration joint body.

28. The method of claim 24, further comprising running in to and/or retrieving the rotation control device from the inner through bore of the integration joint body independently of the annular seal device.

29. The method of claim 24, further comprising running in to and/or retrieving the rotation control device from the inner through bore of the integration joint body with at least one annular seal device.

30. The method of claim 24, further comprising:

running one or both of the rotating control device and the at least one annular seal device into the inner through bore of the integration joint body through the upper portion of the riser system; and locking one or both of the rotating control device and the at least one annular seal device to the integration joint body.

31. The method of claim 24, further comprising:

de-energising or deflating each annular seal device to not seal against the tubular work string; and passing said tubular work string through each annular seal device.

32. The method of claim 24, further comprising:

energising or inflating each annular seal device to seal against a tubular work string; and passing said tubular work string through each annular seal device.

* * * * *